US007082969B1

(12) United States Patent
Hollerback

(10) Patent No.: US 7,082,969 B1
(45) Date of Patent: Aug. 1, 2006

(54) TOTAL CONTAINMENT FLUID DELIVERY SYSTEM

(76) Inventor: Christopher J. Hollerback, 5833 W. 75th Ave., Arvada, CO (US) 80003

( * ) Notice: Subject to any disclaimer, the term of this patent is extended or adjusted under 35 U.S.C. 154(b) by 0 days.

(21) Appl. No.: 11/045,501

(22) Filed: Jan. 28, 2005

(51) Int. Cl.
*B65B 1/04* (2006.01)

(52) U.S. Cl. ..... 141/59; 141/392; 141/98; 141/38; 220/86.2

(58) Field of Classification Search ..... 141/59, 141/286, 38, 83, 98, 94, 301, 302, 351, 392; 220/86.2
See application file for complete search history.

(56) References Cited

U.S. PATENT DOCUMENTS 5,295,521 A * 3/1994 Bedi ..... 141/59
5,301,723 A * 4/1994 Goode ..... 141/82
5,996,649 A * 12/1999 Sutton et al. ..... 141/59
6,196,280 B1 * 3/2001 Tate et al. ..... 141/302
6,463,967 B1 * 10/2002 Boyle ..... 141/94

* cited by examiner

*Primary Examiner*—Steven O. Douglas
(74) *Attorney, Agent, or Firm*—John L. Isaac

(57) ABSTRACT

A closed loop system is disclosed for transferring fluid from a fluid storage vessel to a fluid receiving container. The system is adapted to vent the fluid receiving container while preventing discharge of both vapor and fluid into the surrounding environment. The system includes an enclosed fluid receiving container having upper and lower portions. A fluid flow receiving unit is mounted proximate the fluid receiving container. The receiving unit has a pair of spaced fluid ports and a pair of non-spill coupling connectors extending from the fluid ports, one port being a fluid inlet port and one being a vapor-fluid exit port. A movable cover element is provided for selectively covering and protecting the fluid ports and coupling connectors from contaminants when not in use.

43 Claims, 10 Drawing Sheets

TOTAL CONTAINMENT FLUID DELIVERY SYSTEM

BACKGROUND OF THE INVENTION

1. Field of the Invention

The present invention relates generally to systems and devices for transferring fluids having a vapor component from storage facilities to fluid receiving containers while preventing discharge of vapor or fluid into the environment and, more particularly, to such devices and systems for transferring volatile fluids such as fuel into movable vehicles such as trucks without environmental contamination. Specifically, the present invention relates to a total containment system for high volume fuel delivery for fleet vehicles that simultaneously attends to multiple fluid needs of the fleet vehicle while providing vehicle information to both the owner as well as the fueling station.

2. Description of the Prior Art

There are many different situations that require the transfer of fluids having volatile vapor components from one container to another, such as from a storage container to a fluid receptacle. In such situations, it is highly desirable, and even at times required, to prevent the spillage of any fluids or the release of any vapors during the transfer process.

One example of this involves the refueling of movable vehicles, such as automobiles and trucks. There are various concerns involved during the refueling process. These concerns include the spillage of liquid fuel both during and after the refueling process, the venting of vapors during and after refueling that are hazardous to the individual performing the refueling, the release of vapors displaced during the process of refueling, and drips and spills both immediately before and after refueling. To address these various concerns, a great amount of effort has previously been made to eliminate the spillage of fuel both before, during and after the refueling operation. Examples of delivery nozzle devices that are intended to accomplish this task include those disclosed in U.S. Pat. No. 5,813,443, U.S. Pat. No. 5,868,175, U.S. Pat. No. 6,311,742, U.S. Pat. No. 6,405,768, U.S. Pat. No. 6,520,222, U.S. Pat. No. 6,585,014, U.S. Patent Application No. 2002/0069934, U.S. Patent Application No. 2002/0121313, PCT Publication No. WO 91/01266 and EPO Patent Publication No. 0 349 316.

Other approaches to addressing the above problems include system designs that involve fuel dispensing devices interacting with the receiving container itself to attempt to eliminate the above problems. Some examples of such approaches include system is disclosed in U.S. Pat. No. 3,946,758, U.S. Pat. No. 5,295,521, U.S. Pat. No. 5,385,178, U.S. Patent Application No. 2003/0079797, and French Patent No. 2,600,318.

While many of the above approaches do eliminate a substantial portion of vapor emissions as well as reduce fuel spillage, they do not totally eliminate the problem of environmental contamination from drips, leaks, fumes and vapor from raw petroleum fuels. Moreover, they do not address the additional issues of concern to fleet vehicle operators and owners. These issues include high volume and high speed fuel transfer, the transfer of non-fuel fluids required by truck operators, such as oil, hydraulic fluid, engine coolant, transmission fluid, windshield solvent and urea, the monitoring and maintenance of tire pressure, and the monitoring and maintenance of other vehicle safety and subsystems. While U.S. Pat. No. 6,463,967 discloses a system for diagnosing and reporting the condition of vehicle subsystems while refueling, there is no system to address the needs for changing the conditions that are monitored. Therefore, there remains a need in the art for such a device and system, and the present invention addresses and solves these particular problems in the art.

SUMMARY OF THE INVENTION

Accordingly, it is one object of the present invention to provide a fluid delivery system that is totally contained.

It is another object of the present invention to provide a vehicle fueling system that is rapid, high volume, without risk of environmental contamination from fumes or liquids, and is robotically adaptable.

Yet another object of the present invention is to provide a truck fueling system that enables the monitoring and addition of a plurality of other liquids required for truck operation substantially simultaneous with the fueling operation while utilizing the same delivery apparatus.

A further object of the present invention is to provide a truck fuel delivery system that also permits the simultaneous monitoring and correction of tire pressure parameters during the refueling process.

Still another object of the present invention is to provide a fleet fueling system that enables fleet operators to track fuel and other operating parameters of vehicles in the fleet.

To achieve the foregoing and other objects and in accordance with the purpose of the present invention, as embodied and broadly described herein, a closed loop system is disclosed for transferring fluid from a fluid storage vessel to a fluid receiving container. The system is adapted to vent the fluid receiving container while preventing discharge of both vapor and fluid into the surrounding environment. The system includes an enclosed fluid receiving container having upper and lower portions. A fluid flow receiving unit is mounted proximate the fluid receiving container. The receiving unit has a pair of spaced fluid ports and a pair of non-spill coupling connectors extending from the fluid ports, one port being a fluid inlet port and one being a vapor-fluid exit port. A movable cover element is provided for selectively covering and protecting the fluid ports and coupling connectors from contaminants when not in use.

A fluid inlet line interconnects the receiving unit inlet port with the interior of the fluid receiving container for directing fluid into the lower portion thereof, and a vacuum return line interconnects the receiving unit exit port with the interior of the fluid receiving container upper portion. The distal end of the vacuum return line is disposed in the receiving container upper portion at a level to evacuate vapor and neutralize pressure from the upper portion thereof as fluid enters the receiving container, and to establish a pre-selected maximum fluid level in the receiving container. A fluid delivery apparatus includes a dispensing head adapted for selective engagement with the receiving unit and has first and second end portions. The first end portion includes a pair of spaced fluid coupling openings forming a fluid delivery outlet and a vapor-fluid return inlet adapted for selective connection to the non-spill coupling connectors of, respectively, the receiving unit fluid inlet and vapor-fluid exit ports. The second end portion has first and second fluid lines operatively coupling a fluid storage vessel with, respectively, the dispensing head fluid delivery outlet and vapor-fluid return inlet.

A fluid vacuum pump is associated with the fluid storage vessel for delivering fluid under pressure to the dispensing head and retrieving vapor from the dispensing head vapor-fluid return inlet. A fluid flow shut-off device is disposed in the dispensing head and is coupled to the vapor-fluid return inlet to prevent fluid flow therethrough. A fluid flow termination element is operatively connected to the fluid flow shut-off device to disengage the dispensing head from the receiving unit and terminate fluid flow from the storage vessel when activated by the shut-off device.

In one modification of the invention, the dispensing head first end portion and the receiving unit are mutually polarized to ensure proper connection of the dispensing head fluid delivery outlet and vapor-fluid return inlet with, respectively, the receiving unit fluid inlet port and the vapor-fluid exit port upon coupling of the dispensing head with the receiving unit. Moreover, the first fluid line of the fluid delivery apparatus interconnects the storage vessel with the dispensing head fluid delivery outlet for delivering fluid under pressure from the pump to the dispersing head fluid delivery outlet, and the second fluid line of the fluid delivery apparatus interconnects the storage vessel with the dispensing head vapor-fluid return inlet for delivering vapor evacuated from the receiving container through the dispersing head vapor-fluid return inlet back to the storage vessel to provide total containment of all fluids and volatile vapors in the system.

In another modification of the invention, the fluid vacuum pump includes a vapor recovery vacuum member for recovering vapor from the fluid receiving container as fluid is introduced therein and direct such vapor to the storage vessel.

In one application of the invention, the vacuum return line in the receiving container is adapted to direct fluid in excess of the pre-selected maximum fluid level in the receiving container back to the dispensing head fluid flow shut-off device to disengage the dispensing head from the receiving unit and terminate fluid flow from the storage vessel. In one modification of this, the vacuum return line in the receiving container is adapted to direct excess fluid in the receiving container back to the storage vessel in the event of fluid flow shut-off device failure to prevent discharge of fluid and vapor into the environment. In addition, the fluid flow termination element comprises a solenoid disposed in the dispensing head arranged to disengage the dispensing head from the receiving unit upon activation thereof by the fluid flow shut-off device.

In another modification of the invention, the closed loop system includes a plurality of separate, redundant safety fluid shut-off components for termination of fluid flow without environmental contamination from fluids and vapors contained in the closed loop system. In one application, the safety fluid shut-off component includes a manually operable latch mechanism attached to the dispensing head for selectively disengaging the dispensing head first end portion from the receiving unit upon manual activation thereof. In another application, one of the safety fluid shut-off components is the fluid flow shut-off device in the form of a flow chamber having an internal float valve shut-off element adapted to permit the free flow of vapor through the chamber, and further adapted for movement caused by hydraulic pressure from the flow of fluid into the chamber to close the chamber to all vapor and fluid flow therein. An electronic circuit couples the fluid flow shut-off device with the fuel vacuum pump to signal the pump to shut down fluid flow to the fluid delivery apparatus upon the float valve closing the chamber.

In still another application, the safety fuel shut-off component comprises the fluid flow termination element in the form of a solenoid disposed in the dispensing head and arranged to disengage the dispensing head first end portion from the receiving unit upon its activation by the fluid flow shut-off device in the dispensing head.

In another modification of the invention, the fluid inlet line includes a terminal flow diverter valve at the distal end thereof in the fluid receiving container. The valve is adapted to absorb the impact of incoming pressurized fluid flow while directing fluid flow radially outwardly therefrom along the bottom surface of the receiving container to prevent fuel foaming and deterioration impact of the container inner surface.

In another modification of the invention, the closed loop system includes a plurality of the fluid receiving containers interconnected for sequential fluid transfer. In one application of this, the plurality of fluid receiving containers includes at least first and second fluid receiving containers. In such an arrangement, the vacuum return line from the first fluid receiving container interconnects with the bottom portion of the second fluid receiving container and is adapted to provide fluid flow from the first fluid receiving container to the second fluid receiving container. A vacuum return line from the second fluid receiving container then interconnects to the receiving unit exit port.

In yet another modification of the invention, the fluid receiving container comprises a fuel tank mounted in a movable vehicle, and the receiving unit is mounted to the side of the vehicle accessible on the exterior surface of the vehicle.

In one application of the invention, the non-spill coupling connectors are in the form of a pair of hermetic, quick-connect coupling elements adapted for rapid interconnection of the receiving unit fluid inlet port and vapor-fluid exit port with, respectively, the dispensing head fluid delivery outlet and vapor-fluid return inlet. The movable cover element is adapted for selective movement between a closed position covering and protecting the fluid inlet port and the vapor-fluid exit port and associated hermetic coupling elements, and an open position permitting engagement of the dispensing head with the receiving unit.

In still another modification of the invention, the closed loop system further includes a mechanism for delivering a plurality of additional secondary fluids to a plurality of respective secondary reservoirs disposed in the vehicle including separate fluid lines interconnected by the dispensing head and the receiving unit, the secondary fluids being delivered substantially simultaneous with the transfer of fuel to the vehicle fuel tank.

In one aspect of this modification, the vehicle includes a magnetic lock-out immobilization feature, and the receiving unit further includes a proximity switch element mounted thereto and connected to the vehicle lock-out immobilization feature. The dispensing head includes a magnetic activation switch mounted to the first end portion for contact with the receiving unit proximity switch when the dispensing head and the receiving unit are coupled. The magnetic activation switch energizes the proximity switch to immobilize the vehicle while the dispensing head is coupled to the receiving unit to prevent inadvertent movement of the vehicle during fluid transfer by the closed loop system.

In one application of the invention, the dispensing head is manually engageable with the receiving unit. Alternatively, the dispensing head is robotically engageable with the receiving unit.

In another modification of the invention, the receiving unit further includes a close range radio-frequency information transfer interface unit mounted thereto and adapted to receive information from associated features on the vehicle. The dispensing head in turn includes a reader element mounted to the first end portion for contact with the interface unit when the dispensing head and the receiving unit are coupled. The reader element downloads information from the interface unit concerning selected functions and features of the vehicle while the dispensing head is coupled to the receiving unit.

In one particular application, the power required to operate the components of the receiving unit is supplied by the dispensing head.

Another modification of the invention includes the movable vehicle having a plurality of axles and tires wherein each tire includes a stem cap tire-pressure sensor element thereon for monitoring the tire pressure thereof relative to a pre-established pressure code. Each of the sensor elements includes a transmitter member for communicating tire pressure relative to the code. The system further includes a narrow band reader element adapted to receive and display coded tire pressures relative to the orientation of the movable vehicle as it pulls into a fueling lane in which the fuel delivery apparatus is mounted.

In one application of this modification, four codes are pre-established for vehicle tires and include a right outer tire, a right inner tire, a left outer tire and a left inner tire. The tire pressure is pre-established at a specific desired level for all tires. Variance of the pressure of each tire from the pre-established pressure is displayed at the fuel delivery apparatus relative to the orientation of the vehicle as it enters the fueling lane and the associated codes displayed thereby to enable adjustment of the appropriate tire pressure as needed.

Another modification of the invention includes a closed loop fuel delivery system for transferring fuel with a vapor component from a fuel storage vessel to a fuel tank located on-board a movable vehicle, which system is adapted to vent the fuel tank while preventing discharge of both vapor and fuel into the surrounding environment. The system includes a fuel storage vessel including a fuel pump associated therewith for delivering fuel under pressure. A fuel delivery apparatus includes a dispensing head having first and second end portions. The first end portion has a fuel delivery port and a vapor-fuel return port spaced from each other, and the second end portion has a first fuel flow line interconnecting the storage vessel with the dispensing head fuel delivery port for delivering fuel under pressure from the pump to the dispersing head, and a second vapor-fuel flow line interconnecting the storage vessel with the dispensing head vapor-fuel return port for delivering vapor and overflow fuel evacuated from the vehicle fuel tank back to the storage vessel to provide total containment of all fuel and volatile vapors in the system.

A fuel receiving unit is mounted in the vehicle and has a pair of spaced fluid ports, one port being a fuel inlet port and one port being a vapor-fuel exit port, and a movable cover element for selectively covering and protecting the receiving unit fuel ports from contaminants when not in use. A pair of quick-connect, air and liquid-tight coupling members interconnect, respectively, the fuel delivery port with the fuel inlet port and the vapor-fuel return port with the vapor exit port upon coupling of the dispensing head with the receiving unit, each coupling member having a male portion connected to one port and a female portion connected to the opposite interconnecting port. An enclosed fuel tank is disposed in the vehicle and has upper and lower portions. The tank further includes a fuel inlet line interconnecting the fuel inlet port at the receiving unit with the interior of the fuel tank lower portion for directing fuel into the lower portion of the tank, and a vapor outlet line interconnecting the vapor exit port at the receiving unit with the interior of the fuel tank upper portion. The distal end of the vapor outlet line is disposed in the fuel tank upper portion at a level to evacuate vapor and neutralize pressure from the upper portion of the tank and direct the vapor to the storage vessel as fluid is introduced into the tank, the distal end establishing a pre-selected maximum fuel level in the tank;

A magnetic lock-out immobilization device is mounted to the vehicle to selectively prevent movement thereof, while a proximity switch element is mounted to the receiving unit and connected to the vehicle lock-out immobilization device. A magnetic activation switch is mounted to the dispensing head first end portion for contact with the receiving unit proximity switch when the dispensing head and the receiving unit are coupled. The magnetic activation switch energizes the proximity switch to activate the lock-out immobilization device and immobilize the vehicle while the dispensing head is coupled to the receiving unit to prevent inadvertent movement of the vehicle during fuel transfer by the closed loop system. Finally, a fuel flow shut-off device is disposed in the dispensing head and coupled to the vapor-fuel return port to prevent fluid flow therethrough. A fuel flow termination element is then operatively connected to the fuel flow shut-off device to disengage the dispensing head from the receiving unit and terminate fuel flow from the storage vessel when activated by the shut-off device.

In still another, more specific modification, a closed loop fuel delivery and receiving system is disclosed for transferring fuel with a vapor component from a fuel storage vessel to a fuel tank located on-board a movable vehicle, which system is adapted to vent the fuel tank while preventing discharge of both vapor and fuel into the surrounding environment. The system includes a fuel storage vessel including a fuel pump associated therewith for delivering fuel under pressure. A fuel delivery apparatus includes a dispensing head having first and second end portions, the first end portion including a fuel delivery port and a vapor-fuel return port spaced from each other. The second end portion includes a first fuel flow line interconnecting the storage vessel with the dispensing head fuel delivery port for delivering fuel under pressure from the pump to the dispersing head, and a second vapor-fuel flow line interconnecting the storage vessel with the dispensing head vapor-fuel return port for delivering vapor and overflow fuel evacuated from the vehicle fuel tank back to the storage vessel to provide total containment of all fuel and volatile vapors in the system, the fuel vacuum pump associated with the fuel storage vessel being adapted to both deliver fuel under pressure to the dispensing head and retrieve vapor from the dispensing head vapor-fuel return port.

A fuel receiving unit is mounted in the vehicle and has a pair of spaced fluid ports, one port being a fuel inlet port and one port being a vapor-fuel exit port. A movable cover element is provided for selectively covering and protecting the receiving unit fuel ports from contaminants when not in use, the power required to operate the components of the receiving unit being supplied by the dispensing head. A pair of quick-connect, air and liquid-tight coupling members interconnect, respectively, the fuel delivery port with the fuel inlet port and the vapor-fuel return port with the vapor-fuel exit port upon coupling of the dispensing head with the receiving unit, each coupling member having a male portion connected to one port and a female portion connected to the opposite interconnecting port.

An enclosed fuel tank is disposed in the vehicle and has upper and lower portions. The tank further includes a fuel inlet line interconnecting the fuel inlet port at the receiving unit with the lower portion interior of the fuel tank for directing fuel into the lower portion of the tank. A vapor outlet line is also provided for interconnecting the vapor-fuel exit port at the receiving unit with the interior of the fuel tank upper portion. The distal end of the vapor outlet line is disposed in the fuel tank upper portion at a level to evacuate vapor and neutralize pressure from the upper portion of the tank and directing the vapor to the storage vessel as fluid is introduced into the tank, the distal end establishing a pre-selected maximum fuel level in the tank.

A mechanism is provided for delivering a plurality of additional secondary fluids to a plurality of respective secondary reservoirs disposed in the vehicle including separate fluid lines interconnected by the dispensing head and the receiving unit. The secondary fluids are delivered substantially simultaneous with the transfer of fuel to the vehicle fuel tank. A magnetic lock-out immobilization device is mounted to the vehicle to selectively prevent movement thereof, and a proximity switch element is mounted to the receiving unit and connected to the vehicle lock-out immobilization device. A magnetic activation switch is mounted to the dispensing head first end portion for contact with the receiving unit proximity switch when the dispensing head and the receiving unit are coupled. The magnetic activation switch energizes the proximity switch to activate the lock-out immobilization device and immobilize the vehicle while the dispensing head is coupled to the receiving unit to prevent inadvertent movement of the vehicle during fuel transfer by the closed loop system.

A fuel flow shut-off device is disposed in the dispensing head and coupled to the vapor-fuel return inlet to prevent fluid flow therethrough, the vapor outlet line in the fuel tank being adapted to direct fuel in excess of the pre-selected maximum fuel level in the fuel tank back to the dispensing head fluid flow shut-off device to activate the shut-off device. The shut-off device includes a flow chamber having an internal float valve shut-off element adapted to permit the free flow of vapor through the chamber, and further adapted for movement caused by hydraulic pressure from the flow of fuel into the chamber to close the chamber to all vapor and fuel flow therein. An electronic circuit couples the fuel flow shut-off device with the fuel vacuum pump to signal the pump to shut down fuel flow to the fuel delivery apparatus upon activation of the fuel flow shut-off device.

A fuel flow termination element is provided and is in the form of a solenoid disposed in the dispensing head operatively connected to the fuel flow shut-off device. The solenoid is arranged to disengage the dispensing head first end portion from the fuel tank and terminate fuel flow from the storage vessel upon its activation by the fuel flow shut-off device. The vapor outlet line in the fuel tank is adapted to direct excess fuel in the fuel tank back to the storage vessel in the event of fuel flow shut-off device failure to prevent discharge of fuel and vapor into the environment.

A fuel flow termination element safety component is provided in the form of a manually operable latch mechanism attached to the dispensing head for selectively manually disengaging the dispensing head first end portion from the receiving unit in the event of failure of the solenoid. A close range radio-frequency information transfer interface unit is mounted to the receiving unit and is adapted to receive information from associated features on the vehicle. Finally, a reader element is mounted to the dispensing head first end portion for contact with the interface unit when the dispensing head and the receiving unit are coupled. The reader element is adapted for downloading information from the interface unit concerning selected functions and features of the vehicle while the dispensing head is coupled to the receiving unit.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE EXEMPLARY EMBODIMENTS

As described above, prevailing vapor recovery techniques during a vehicle refueling process deal primarily with the capture of vapor at the dispensing equipment, and in particular the nozzle. In contrast to this, the system of the present invention focuses on the conversion of the receiving vessel in a manner that results in the capture and containment of all of the liquid, vapor and pressure of the delivered fluid. This is accomplished by providing a sealed loop for fluid transfer from the storage vessel to the receiving vessel and back again to the starting point without an external release port. A dual path, vehicle-mounted conduit mates with a sealed dispensing delivery apparatus to form a closed loop or total containment fluid delivery system.

The present invention includes an intrinsically safe fluid shut-off with a data transfer and receiving interconnect in one compact connection. The two system connection components connect, dispense and disconnect without the release of liquid or vapor contamination to the surrounding environment while simultaneously communicating information critical to the maintenance or management of the receiving vessel. The system of the invention does not utilize any external pressure relief device in the delivery process and includes a plurality of redundant safety arrangements to insure against environmental contamination.

Figure 1:
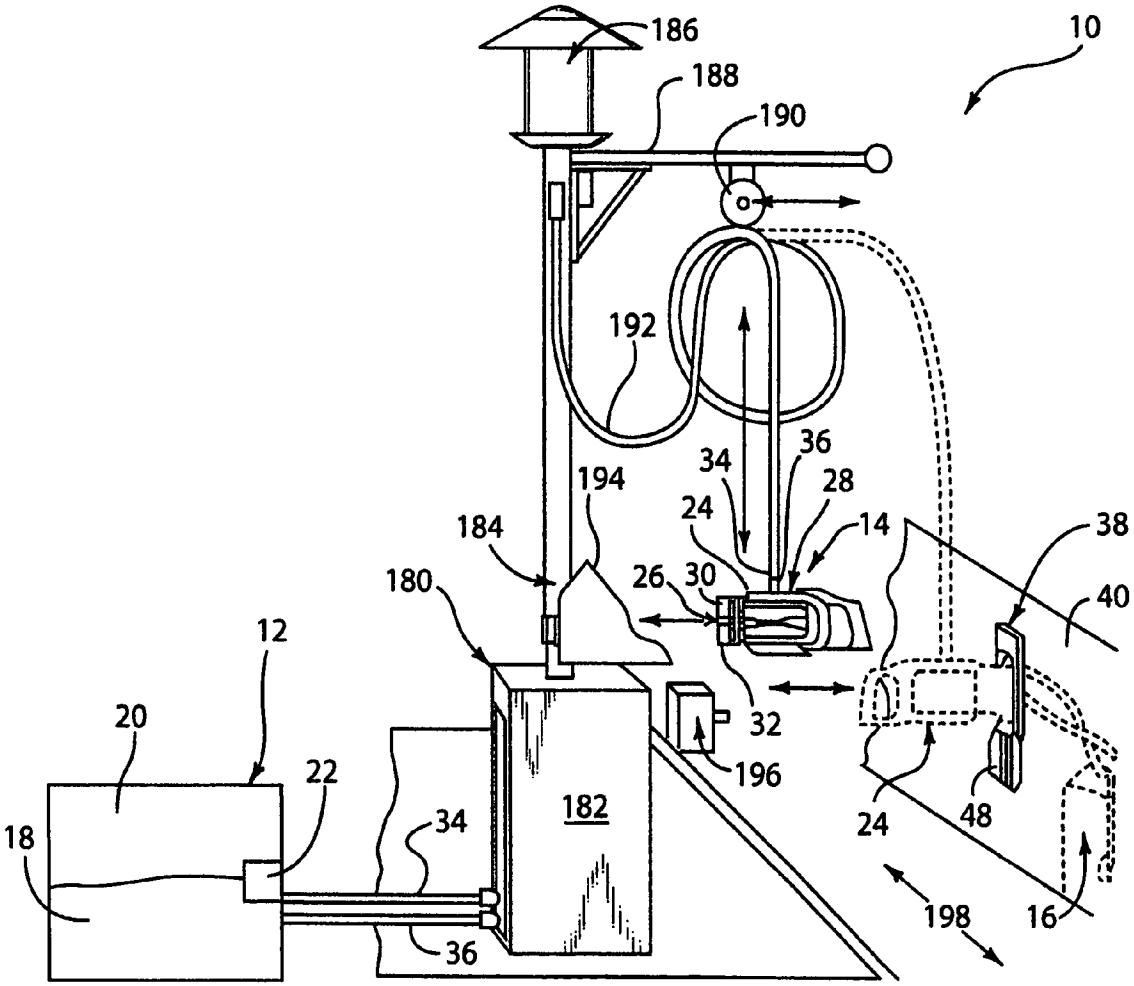
FIG. 1 is a side perspective of a fluid delivery apparatus for the closed loop fluid transfer system constructed in accordance with the present invention.
Figure 1A:
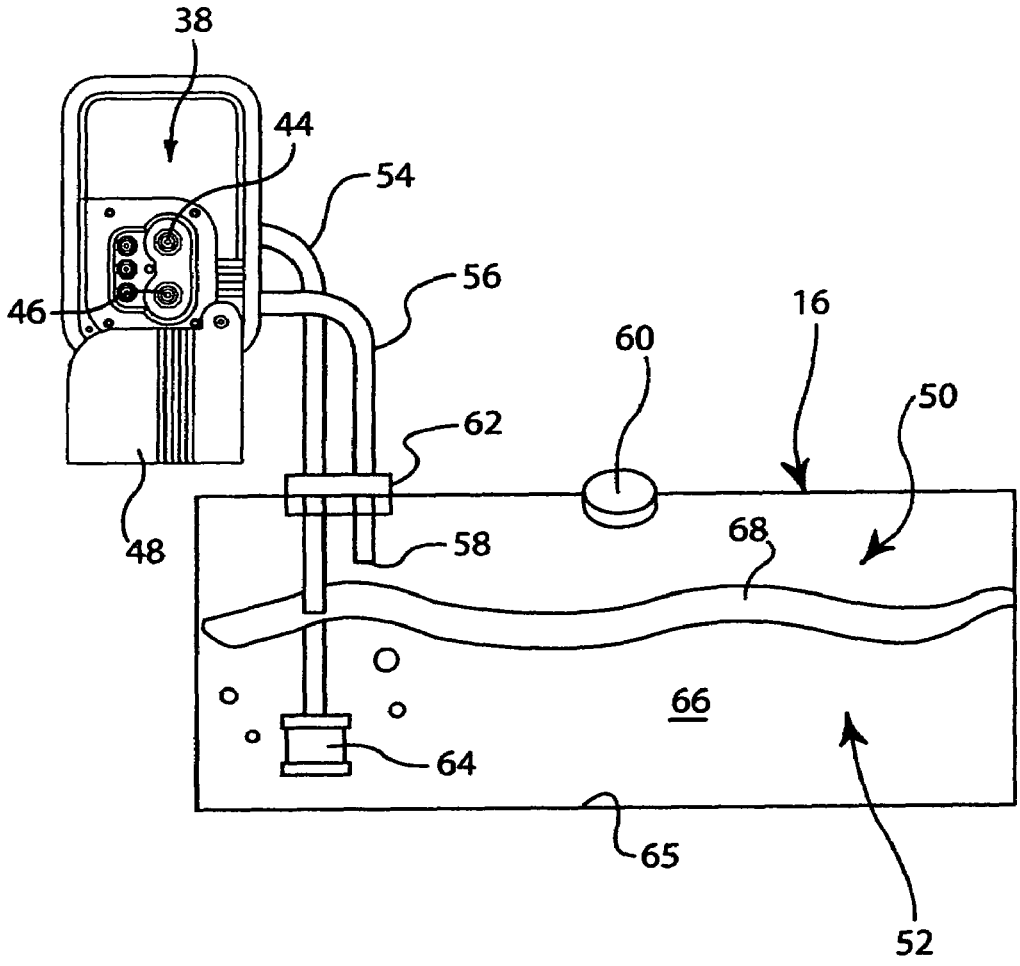
FIG. 1A is a schematic of the fluid receiving container for the closed loop fluid transfer system constructed in accordance with the present invention.

Referring now to FIGS. 1 and 1A, the system 10 of the invention includes a fluid storage vessel 12, a fluid delivery apparatus 14 and a fluid receiving container 16. In the most preferred form and for illustrative purposes herein, the system 10 will be discussed in terms of a fuel delivery and receiving system for moving vehicles, and in particular for fleet trucks. However, it should be understood that the present invention is applicable to any type of fluid transfer environment including non-commercial vehicles, industrial fluid transfer applications, marine applications and the like.

The fluid storage vessel 12 is divided into two compartments 18, 20. The first compartment 18 is designed to store the fluid being held for delivery, for example diesel fuel for trucks and the like. The second compartment 20 is designed to store evacuated vapor fumes as well as excess fuel returned in the case of system shut-off failure as described in greater detail below. A fuel vacuum pump 22 of standard design is associated with the storage vessel 12 for delivering fluid to the apparatus 14 under pressure as well as retrieving vapor and pressure from the receiving container 16 as described below.

In one preferred form, the fluid delivery apparatus 14 includes a dispensing head 24 generally in the form of a of gun-shaped housing having a front end portion 26, a top end portion 28 and a handle 29. The front end portion 26 includes a fuel delivery port 30 and a vapor-fuel return port 32 spaced from each other. The top end portion 28 is preferably attached to a first fuel flow line 34 which operatively interconnects the compartment 18 of the storage vessel 12 with the dispensing head fuel delivery port 30 for delivering fuel under pressure from the pump 22 to the dispensing head 24. A second vapor-fuel flow line 36 extends from the top end portion 28 and interconnects the compartment 20 of the storage vessel 12 with the dispensing head vapor-fuel return port 32 to deliver vapor and overflow fuel evacuated from the receiving container 16 back to the storage vessel 12. In this manner, total containment is provided for all fuel and volatile vapors by the system 10.

A fuel receiving unit 38 is provided and is preferably mounted proximate to the fluid receiving container 16. It should be understood that the fluid receiving container 16 may be a stationary receptacle or in the form of a tank mounted as a component of a movable vehicle, such as a truck or automobile. In the illustrated embodiment wherein the container 16 is a fuel tank mounted in a movable vehicle 40, the receiving unit 38 is preferably mounted to the side of the movable vehicle 40 containing the tank 16. In preferred form, the receiving unit 38 includes a pair of spaced fluid ports, one being a fuel inlet port 44 and one being a vapor-fuel exit port 46. The fuel inlet port 44 is adapted to mate with the fuel delivery port 30 of the dispensing head 24, while the vapor-fuel exit port 46 is adapted to mate with the vapor-fuel return port 32 of the dispensing head as described in greater detail below. A movable cover element 48 is provided for selectively covering and protecting the receiving unit fuel ports 44, 46 from airborne contaminants when not in use. The power required to operate the components of the receiving unit 38 are preferably supplied by the dispensing head 24 as described below.

In preferred form, the fluid receiving container 16 is in the form of an enclosed fuel tank disposed in the vehicle 40 and includes an upper portion 50 and a lower portion 52. A fuel inlet line 54 interconnects the fuel inlet port 44 at the receiving unit 38 with the interior of the lower portion 52 of the fuel tank 16 for directing fuel into the lower portion 52 of the tank 16. A vapor outlet line 56 likewise interconnects the vapor-fuel exit port 46 at the receiving unit 38 with the interior of the fuel tank upper portion 50. The distal end 58 of the vapor outlet line 56 is positioned in the fuel tank upper portion 50 at a level to evacuate vapor and neutralize pressure from the upper portion 50 of the tank 16 and direct the vapor to the compartment 20 of the storage vessel 12 as fluid is introduced into the tank 16 through the line 54. The distal end 58 establishes a pre-selected maximum fluid level in the tank container 16.

A standard fuel cap 60 is provided for fuel filling of the tank 16 utilizing standard dispensing nozzles. In addition, a cap 62 provides airtight access to the tank 16 for the lines 56, 58. In order to permit rapid filling of thee tank 16 without foaming, a fluid diffuser head 64 is preferably attached to the distal end of the fuel inlet line 54 in the tank 16. The diffuser head 64 also reduces the impact velocity of the fluid on the interior lining of the tank 16 by directing the rapid flowing fluid substantially parallel along the bottom 65 of the tank 16. This reduces wear and thus prolongs life of the tank 16. An example of one such diffuser head is illustrated in U.S. Pat. No. 4,040,448, although any type of diffuser head may be utilized to divert the fluid flow in a plurality of directions substantially parallel to the tank 16 bottom surface 65.

When fluid is discharged from the storage vessel 12 into the tank 16 by way of the dispensing head 24, the receiving unit 38 and the fuel inlet line 54, the fluid 66 fills the tank 16 while vapor and excess pressure in the tank escapes through the vapor outlet line 56. Once the surface 68 of the fluid 66 reaches the distal end 58 of the vapor outlet line 56, the pre-selected maximum fluid level is reached. At this point in time, fluid then enters the vapor outlet line 56 and is returned to the receiving unit 38 and the dispensing head 24 to terminate fluid flow as described in detail below. Thus, the maximum fluid level in the tank 16 is determined by the relative position of the distal end 58 of the line 56 in the upper portion 50 of the tank 16. Moreover, this event triggers the termination of fluid flow to the tank 16 as described below.

Figure 2:
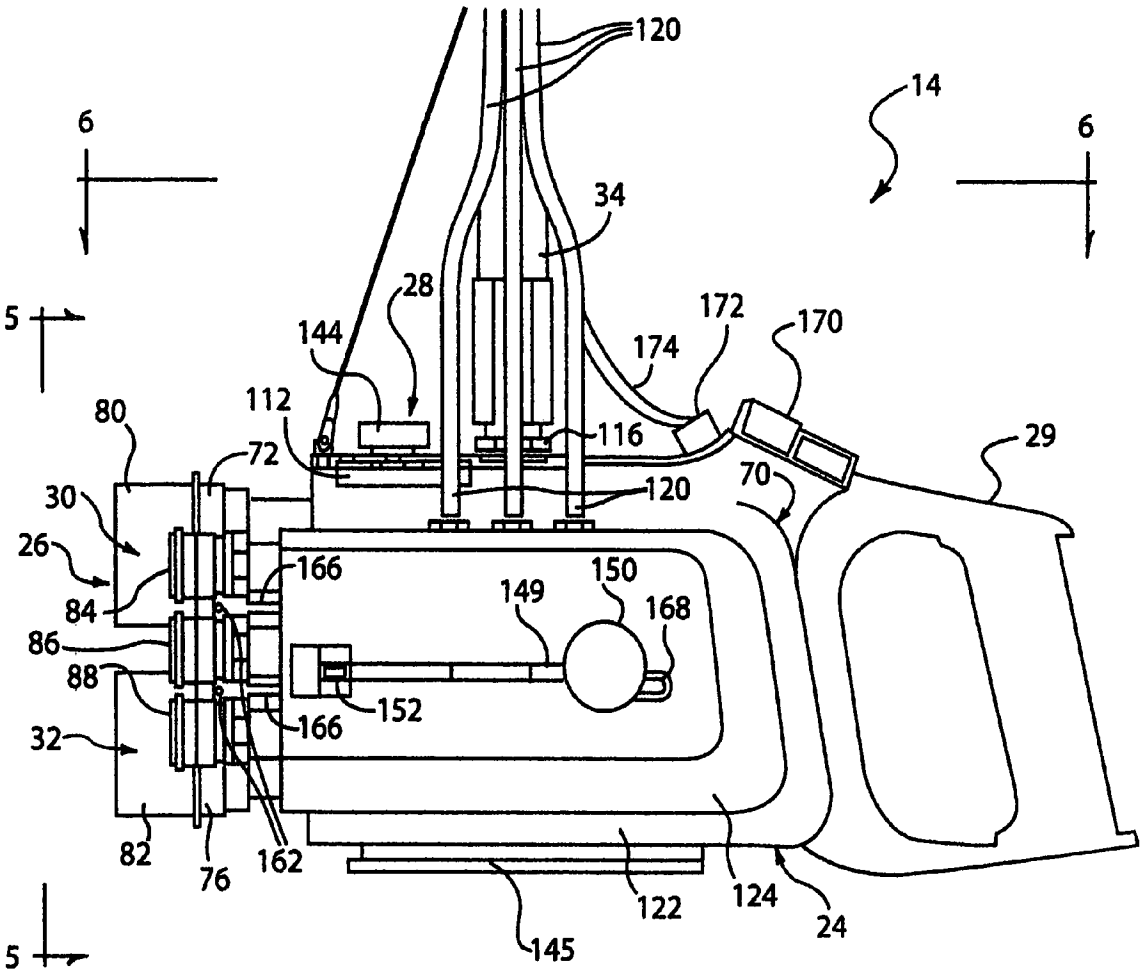
FIG. 2 is an enlarged side view of a dispensing head embodiment for the fuel delivery apparatus of the present invention.
Figure 3:
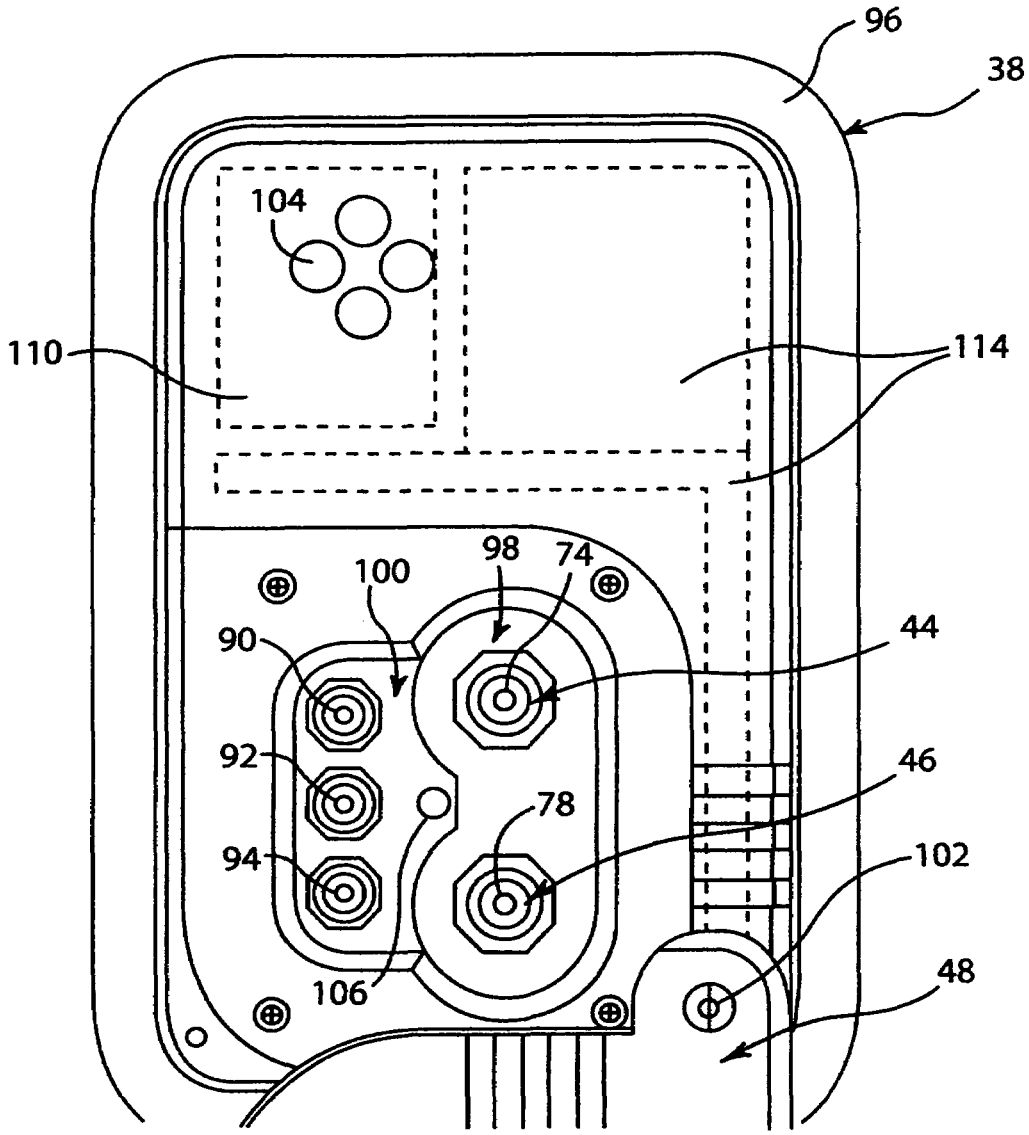
FIG. 3 is an enlarged front view of a fluid flow receiving unit embodiment for the closed loop fluid transfer system constructed in accordance with the present invention and with its cover element in an open position.
Figure 4:
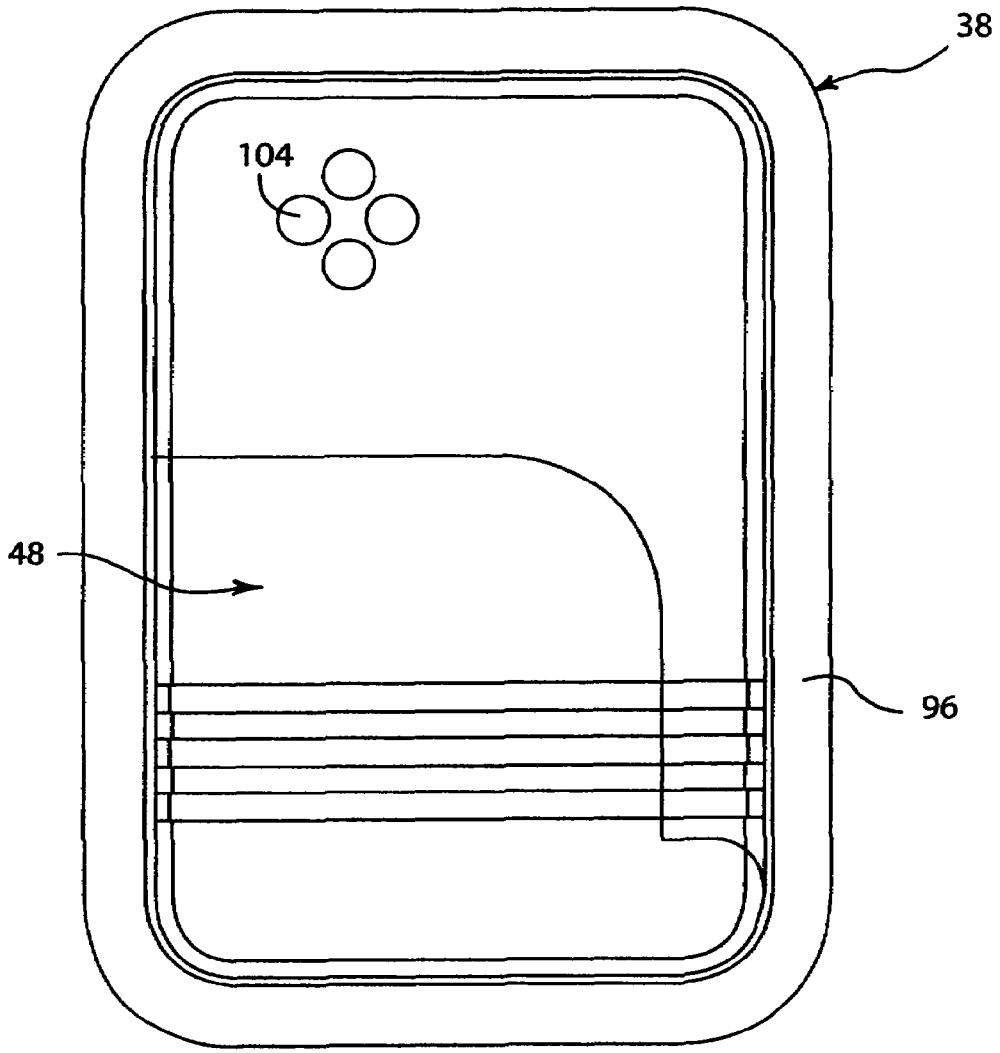
FIG. 4 is a view similar to that of FIG. 3 but with its cover element in a closed position.

Referring now more particularly to FIGS. 2–4, the preferred dispensing head 24 and the fluid receiving unit 38 are described in greater detail. As previously indicated, the dispensing head 24 is preferably in the form of a gun-shaped housing 70 and includes a front end portion 26, a top portion end portion 28 and a handle 29. The fuel delivery port 30 and vapor-fuel return port 32 are spaced from each other at the front end portion 26. A pair of quick-connect, air and liquid-tight coupling members 72, 74 and 76, 78 interconnect, respectively, the fuel delivery port 30 with the fuel inlet port 44 of the receiving unit 38, and the vapor-fuel return port 32 with the vapor-fuel exit port 46 upon coupling of the dispensing head 24 with the receiving unit 38. In preferred form, each pair of coupling members 72, 74 and 76, 78 has a male portion connected to one port and a female portion connected to the opposite interconnecting port. In the illustrated embodiment, the connecting members 74, 78 disposed on the receiving unit 38 ports 44, 46 are female connectors in the form of self-sealing nipples that protrude out from the ports 44, 46. The connecting members 72, 76 disposed on the ports 30, 32 of the dispensing head 24 are male connectors in the form of self-sealing, ball lock couplers having plastic alignment collars 80, 82, respectively, that protrude out from the ports 30, 32 and are adapted for non-spill, simultaneous connection to the female nipples 74, 78 of the fluid receiving unit 38. It should be understood, however, that any type of quick-connect, air and liquid-tight coupling members may be used as the members 72, 74 and 76, 78 to accomplish the desired purpose.

The front end portion 26 also includes a plurality, and preferably three, of secondary fluid delivery ports 84, 86 and 88. These fluid delivery ports 84–88 are sized and shape for releasable interconnection with secondary fluid input ports 90, 92 and 94 disposed on the receivable unit 38. The fluid delivery ports 84–88 are capable of multiple combinations of fluid transfer to remote receptacles (not illustrated) disposed in a movable vehicle. Examples of such fluids include engine oil, engine coolant, urea, transmission fluid, hydraulic fluid and windshield solvent. In this manner, connection of the front end portion 26 of the dispensing head 24 with the fluid receiving unit 38 can effect the simultaneous transfer of a plurality of fluids in addition to fuel to a movable vehicle such as a fleet truck.

Figure 6:
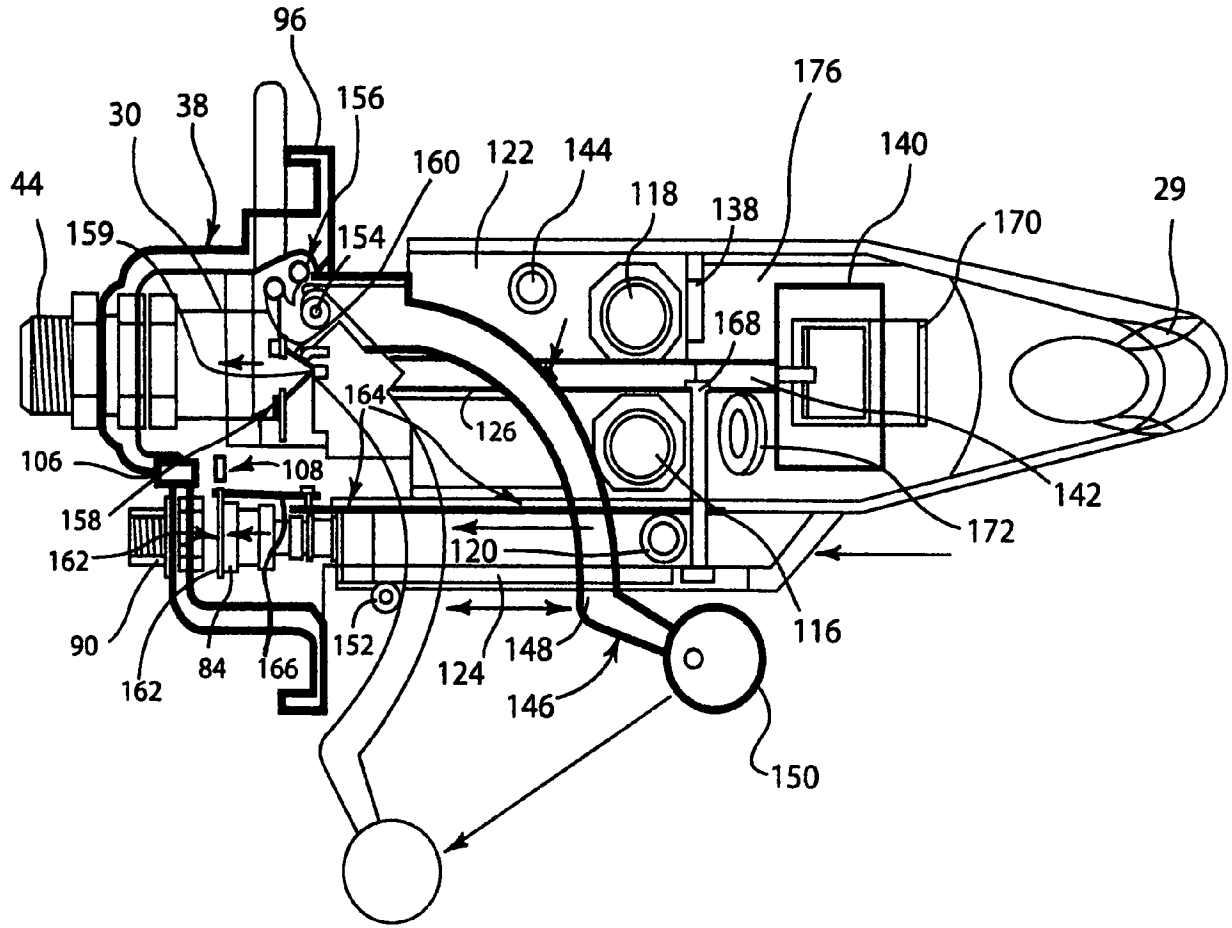
FIG. 6 is a top view of the dispensing head of FIG. 2 taken substantially along line 6—6 of FIG. 2 and engaged with the receiving unit of FIG. 3, illustrating some components in shadow.
Figure 7:
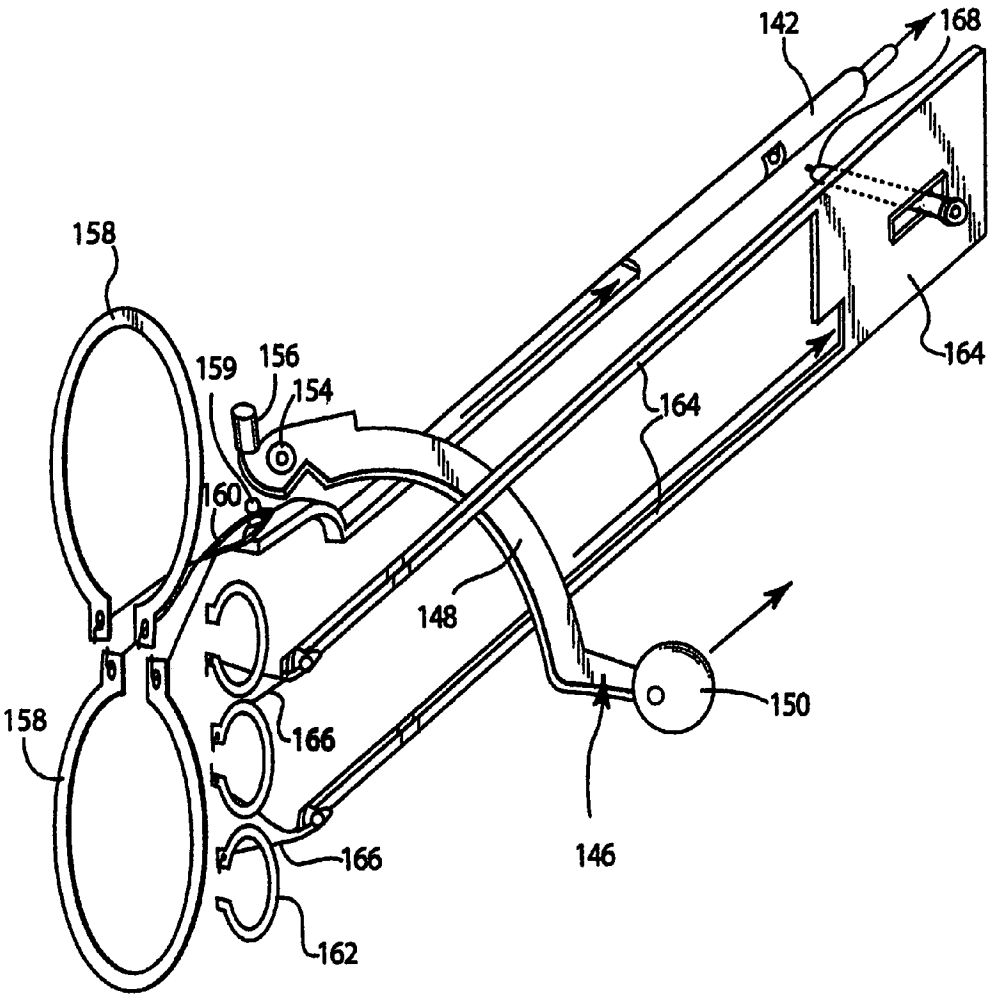
FIG. 7 is an exploded view of a hand latch release mechanism for use with the dispensing head embodiment illustrated in FIGS. 5 and 6.

Referring particularly to FIGS. 3, 4 and 6, the receiving unit 38 preferably includes a casing element 96 having a first recessed area 98 and a second recessed area 100 positioned adjacent thereto, the first recessed area 98 having a greater depth than the second recessed area 100. The fuel inlet port 44 and the vapor-fuel exit port 46 are positioned within the first recessed area 98, while the secondary fluid input ports 90, 92 and 94 are positioned within the second recessed area 100. The cover element 48 is preferably rotationally mounted toward the outer edge of the casing element 96 by a pivot pin 102 so that it may move between an open position exposing the interior of the casing 96 as illustrated in FIG. 3, and a closed position which covers all the components within the casing 96 as illustrated in FIG. 4. A low voltage electrical contact cluster 104 is preferably provided within the casing at 96 above the recessed areas 98, 100. The cluster 104 provides for optional automation to power the cover 48 and move it between its opened and closed positions when in a robotics application, as discussed in more detail below.

Figure 5:
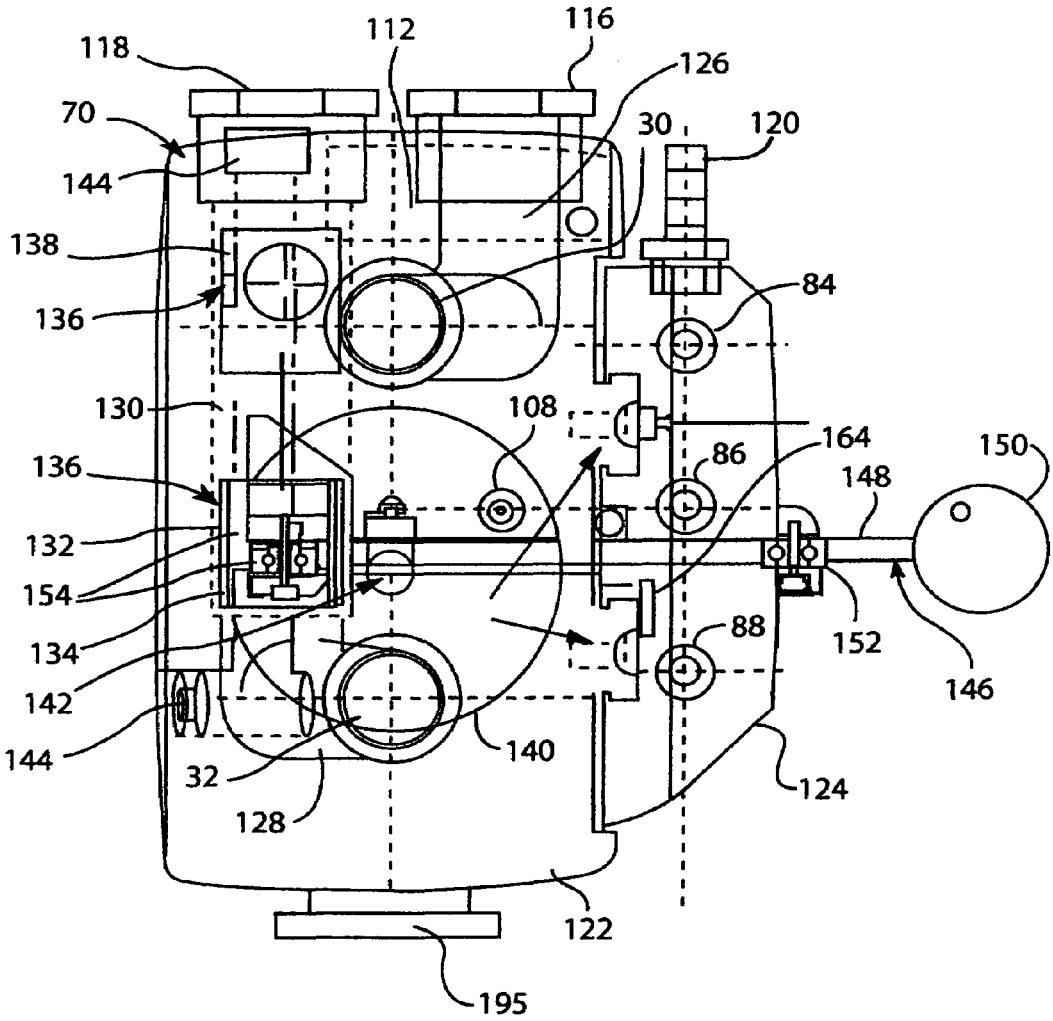
FIG. 5 is a front view of the dispensing head of FIG. 2 taken substantial along line 5—5 of FIG. 2 and illustrating some components in shadow.

In addition, a proximity switch 106, which is preferably normally a closed circuit, is provided within the casing 96. In preferred form, the switch connector 106 is a magnetic lockout contact which is preferably connected to a vehicle transmission neutral switch to immobilize a vehicle when the dispensing head 24 is connected to the receiving unit 38 to fuel a vehicle. A magnetic reed activation switch 108 (FIGS. 5–6), preferably a rare earth magnet, is provided at the end portion 26 of the dispensing head 24. The switch 108, when it contacts the switch connector 106, engages the vehicle lockout by interrupting the normally closed circuit in the form of the proximity switch 106.

The casing element 96 of the receiving unit 38 further includes a close range radio-frequency information transfer interface unit 110 mounted thereto, preferably behind the low-voltage cluster 104. The interface unit 110 is adapted to receive information from associated features on the movable vehicle. The dispensing head 24 includes a reader element 112 mounted to the first end portion 26 thereof for contact with the interface unit 110 when the dispensing head 24 and the receiving unit 38 are coupled. The reader element 112 is preferably in the form of an automated information data collection module available on the market and is adapted to download information from the interface unit 110 concerning selected functions and features of the movable vehicle while the dispensing head 24 is coupled to the receiving unit 38. Examples of these features include vehicle mileage, engine run time, non-fuel fluid levels, and the like. This information is particularly important in fleet truck applications so that fleet owners can maintain up to date vehicle information for maintenance and management purposes. This information can be readily gathered utilizing the present invention as the vehicle is refueled. Robotic plates 114 are provided to assist in alignment between the dispensing head 24 and the receiving unit 38 for robotic applications.

Referring now to FIGS. 2 and 5–7, the preferred dispensing head 24 includes a primary fluid input line or hose 34 which is secured to the top end portion 28 thereof by way of a fuel attachment collar 116. The primary fluid input line 34 operatively interconnects the compartment 18 of the storage vessel 12 with the dispensing head fuel delivery port 30 for delivering fuel under pressure from the pump 22 to the dispensing head 24. The second vapor-fuel flow line 36 extends from the top end portion 28 by way of a return attachment collar 118. The line 36 interconnects the compartment 20 of the storage vessel 12 with the dispensing head vapor-fuel return port 32 to deliver vapor and overflow fuel evacuated from the receiving container 16 (FIG. 1) back to the storage vessel 12. Secondary fluid lines 120 interconnect the storage container 12 with the secondary fluid delivery ports 84, 86 and 88 for delivering secondary fluids as described above.

The housing 70 preferably includes a first or primary manifold 122 adapted to house the components for delivering fuel and returning vapor through ports 30, 32, and a second manifold 124 mounted to one side of the primary manifold 122. The second manifold is adapted to house the components for delivering secondary fluids through the ports 84, 86 and 88. The second manifold is mounted for sliding movement relative to the first manifold. In this manner, when the dispensing head 24 is engaged with the receiving unit 38, the engagement and disengagement process becomes a two step procedure. Initially, the ports 30, 32 of the first manifold 122 are engaged with their mating ports 44, 46 of the receiving unit 38. Then, in a second motion or step, the second manifold is moved relative to the first manifold to engage secondary ports 84–88 with their mating ports 90, 92 and 94 of the receiving unit 38. When disengagement is desired, the second manifold 124, along with its ports 84–88, is initially disengaged followed immediately thereafter by disengagement of the first manifold 122 with its ports 30, 32. As a result, if there are no secondary fluids to be delivered, the second manifold 124 is simply not moved and engaged with the receiving unit 38. This two step procedure is enabled in part due to the different depths of the first and second recessed areas 98, 100 of the casing element 96 in the receiving unit 38.

When the dispensing head 24 is fully engaged with the receiving unit 38 and fuel is being delivered, the fluid enters the first housing manifold 122 from the primary fluid input line 34 through the fuel attachment collar 116 into a conduit 126 and is directed into and through the fuel delivery port 30. As indicated previously, the delivered fuel is discharged into a vehicle receiving container 16 through the port 44 and the line 54. Returning vapor from the vehicle receiving container 16 is directed through the port 46 and into the vapor-return fuel port 32 of the first manifold 122. The returning vapor is directed through a conduit 128 into a return flow chamber 130 containing a fluid flow shut-off device 134. The device 134 is preferably in the form of an internal float 134 having a ferrous metal or magnetic collar 136 which allows vapors to pass through it to the vapor-fuel flow line 36 by way of the return attachment collar 118. However, once the receiving container 16 reaches its maximum level, fluid will then return through the port 46, the vapor-return fuel port 32 of the first manifold 122 and into the chamber 130. When this occurs, the hydraulic pressure of the returning fluid moves the ferrous collar 136 upwardly within the chamber 130 into the range of an external inductive sensor 138. The sensor 138, when activated by contact with the float collar 136, triggers an electronic pulse to shut down the fuel supply pump 22. It also triggers a fuel flow termination element 140 preferably in the form of a solenoid which disengages the dispensing head 24 from the receiving unit 38. A large coupler disengagement pull rod 142 is connected to the solenoid for movement to disconnect ports 30, 32 and push the dispensing head 24 from the receiving unit 38. As this occurs, a vacuum relief valve 144 allows air into the chamber 130 to clear fuel from the chamber 130 to return to the receiving container 16 before disengagement of the dispensing head is complete. In this manner, no fuel or vapor will disperse into the environment upon disengagement of the fluid delivery apparatus.

Another one of the safety fluid shut-off components utilized in the preferred embodiment of the invention is in the form of a manually operable latch mechanism 146. In preferred form, the latch mechanism 146 includes a combination coupling engage and eject bar 148 with a push-pull knob 150. A roller bearing push point 152 acts as a stop for movement the engagement bar 148. When dispensing head 48 is first engaged with the receiving unit 38, the bar 146 is in its fully retracted position. The bar 146 is then pushed forward and rotates on a pivoting roller bearing 154 which caries a pawl 156. A first retaining ring set 158 of two rings is adapted to engage the ports 30, 32 and is secured to the distal end pin 159 of the disengagement pull rod 142 by a first spring wire assembly 160. A second retaining ring set 162 of three rings is adapted to engage the ports 84,86,88 and is secured to the distal end of a dual engagement plate 164 by a second spring wire assembly 166. A manifold retaining pin 168 is connected to the disengagement pull rod 142 for automatic coupler disengagement.

The initial push of the bar 148 in a forwardly direction along arrow 170 causes the bar 148 to engage the pin 159 and press the rod 142 and the ports 30, 32 in a forward direction to engage and couple with the ports 44, 46 of the receiving unit 38. A continued forward push on the bar 148 moves the plate 164 a sufficient distance to engage the secondary ports 84–88 with the ports 90–94. To manually disengage the dispensing head 24 from the receiving unit 38, the bar 148 is pulled rearwardly. Alternatively, the solenoid 140 may activate the rod 142 to move it rearwardly. In so doing, the bar 148 is rearwardly moved along with the plate 164 by way of the pin 168 to disengage the dispensing head 28 from the receiving unit 38.

A low voltage, sealed on-off button 170 is also provided, preferably on the handle 29, to start the pump 22 as well as serve as yet another of the redundant safety fluid shut-off components as a shut-off switch. A liquid-tight strain relief element 172 seals and protects the connection of the low voltage data/power cable 174. A NEMA 4 rated electronics chamber 176 is preferably disposed in the first manifold 122 to keep electrical components isolated from the main fueling body of the dispensing head 28. The isolated electrical components housed in the chamber 176 preferably include an on-off switch connected to the exterior button 170, an inductive or magnetic sensor, the release solenoid connections and wiring harness.

Referring back to FIG. 1, a station arrangement 180 may be preferably provided for the system 10. The station 180 preferably includes a base 182 connected to the lines 34, 36. A pole 184 extends upwardly from the base 182 and carries a light fixture 186 on the upper portion thereof. An extension rod 188 projects outwardly from the upper portion of the pole 184 and carries a pulley 190 thereon. The pulley 190 is preferably movable along the length of the rod 188. The primary lines or hoses 34, 36 along with the secondary fluid hoses 120 and the power/data cable 174 are preferably bundled together into a single line connector 192. The line connector 192 is attached to the pulley 190 so that the dispensing head 24 may be adjusted both in height as well as in distance from the pole 184. The dispensing head 24 is secured at its top end portion 28 to the connector line 192 and hung thereby. A holster or slide shoe 194 is provided at the lower portion of the pole 184 to carry the dispensing head 24 when it is not in use. The dispensing head preferably includes a foot bracket 195 adapted to engage the holster 194 as well as a robotics arm in an automated delivery system.

A sensor assembly 196 is preferably provided at the ground surface in the form of a narrow band reader element to measure tire pressure information as described below. When a vehicle, such as a fleet truck 40, moves into position along the drive lane 198, the dispensing head 24 is removed form the holster 194 and engaged with the receiving unit 38 on the side of the truck 40 as described above. While the arrangement illustrated in FIG. 1 shows manual operation of the dispensing head, it should be understood that the dispensing head may be operated robotically. Movement of the dispensing head 24 from the holster 194 to the receiving unit 38 may be performed remotely with appropriate sensors and robotics which are readily available in the art.

Figure 8:
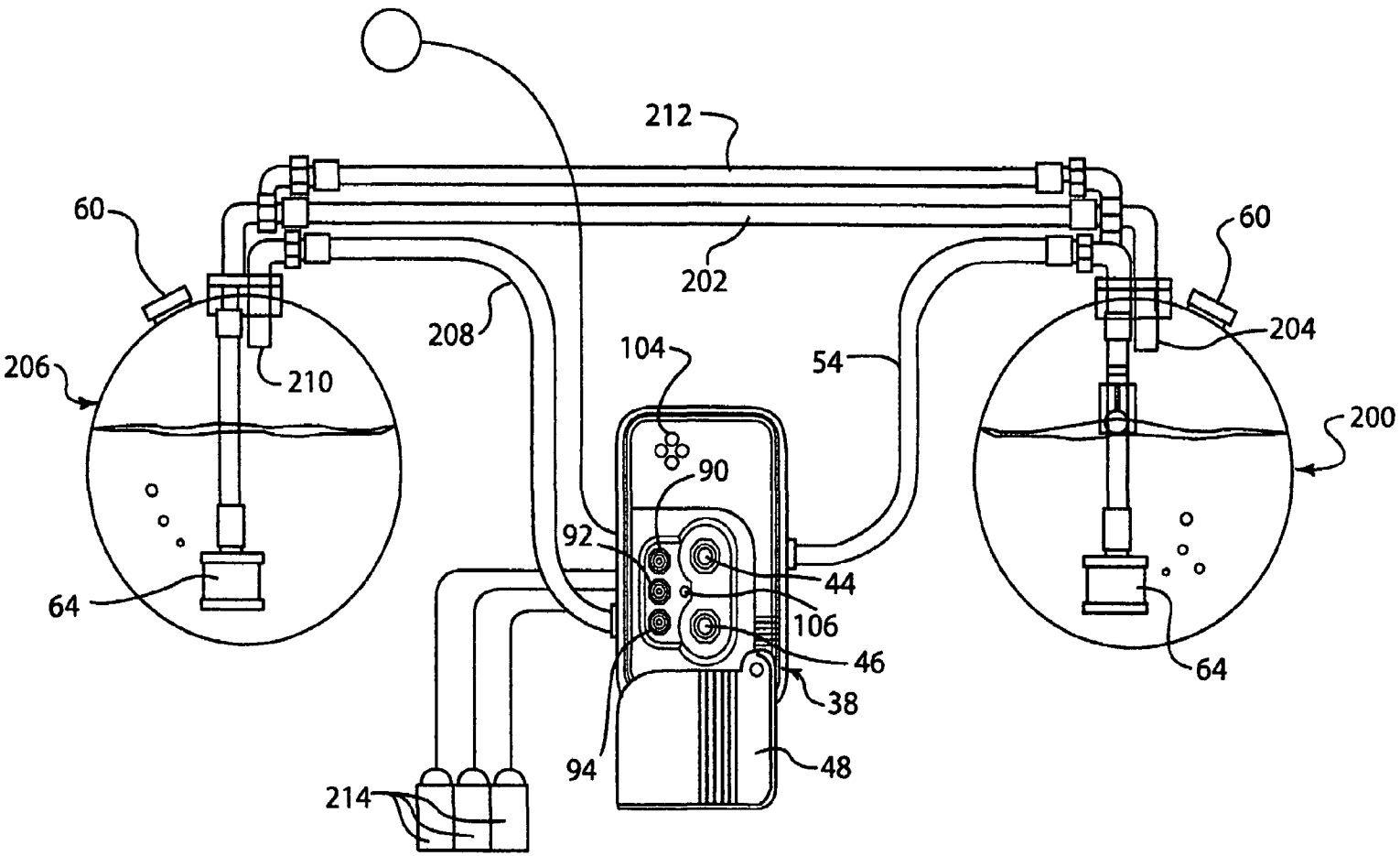
FIG. 8 is a schematic illustrating the fluid flow receiving unit and receiving container for the closed loop fluid transfer system of the present invention adapted for use with a plurality of receiving container tanks fluidically interconnected.

Referring now to FIG. 8, the present invention may also be utilized to simultaneously fill multiple fuel tanks on a vehicle. While this embodiment will be described to fill two receiving containers on a single vehicle, the present invention may fill up to three or more fluid reservoirs or tanks sequentially connected together. In the illustrated embodiment, the receiving unit fuel inlet port 44 is attached to the fuel inlet line 54 which terminates at the bottom of the first tank 200. A diffuser head 64 is attached to the distal end of the line 54 as in the prior embodiment. A cross-over fuel supply line 202 has a first end 204 in the upper portion of the first tank 200 and extends into a second tank 206 toward the bottom thereof. The second end of the line 202 also preferably includes a diffuser element 64. A return hose 208 extends from the upper portion of the second tank 206 to the vapor-fuel exit port 46 of the receiving unit 38. The distal ends 204 and 210 of the lines 202 and 208 establish the maximum fuel level in both tanks 200 and 206. A cross-over vent line 212 is provided between the tanks 200 and 206.

The fluid first flows into the first tank 200 from the inlet port 44 of the receiving unit 38 and the line 54. As the fluid is discharged into the first tank 200, the vapor and pressure generated thereby passes through the distal end 202 and through a fluid cross-over line 204 to the second tank 206. Once the fluid in the first tank 200 reaches the distal end 202 of the cross-over line 204, the end 211 of the vent line 212 is sealed by a ball float 213 causing pressure differential forcing the fluid to pass through the opening 202 and the line 204 into the second tank 206. The second tank 206 then fills with fuel, with the vapor and pressure created from this filling being discharged through the line 208 to the vapor-fuel exit port 46. Once the fuel in the second tank 206 reaches the distal end 210 of the return line 208, the fuel then flows through the line 208 to the port 46, and this action terminates fluid flow as in the prior embodiment. Thus, the two tanks 200 and 206 may be filled sequentially through one filling operation. Additional tanks may also be sequentially strung together in the same manner so that a plurality of tanks may be simultaneously filled. The secondary reservoirs 214 may also be filled similar to the prior embodiment discussed above.

Figure 9:
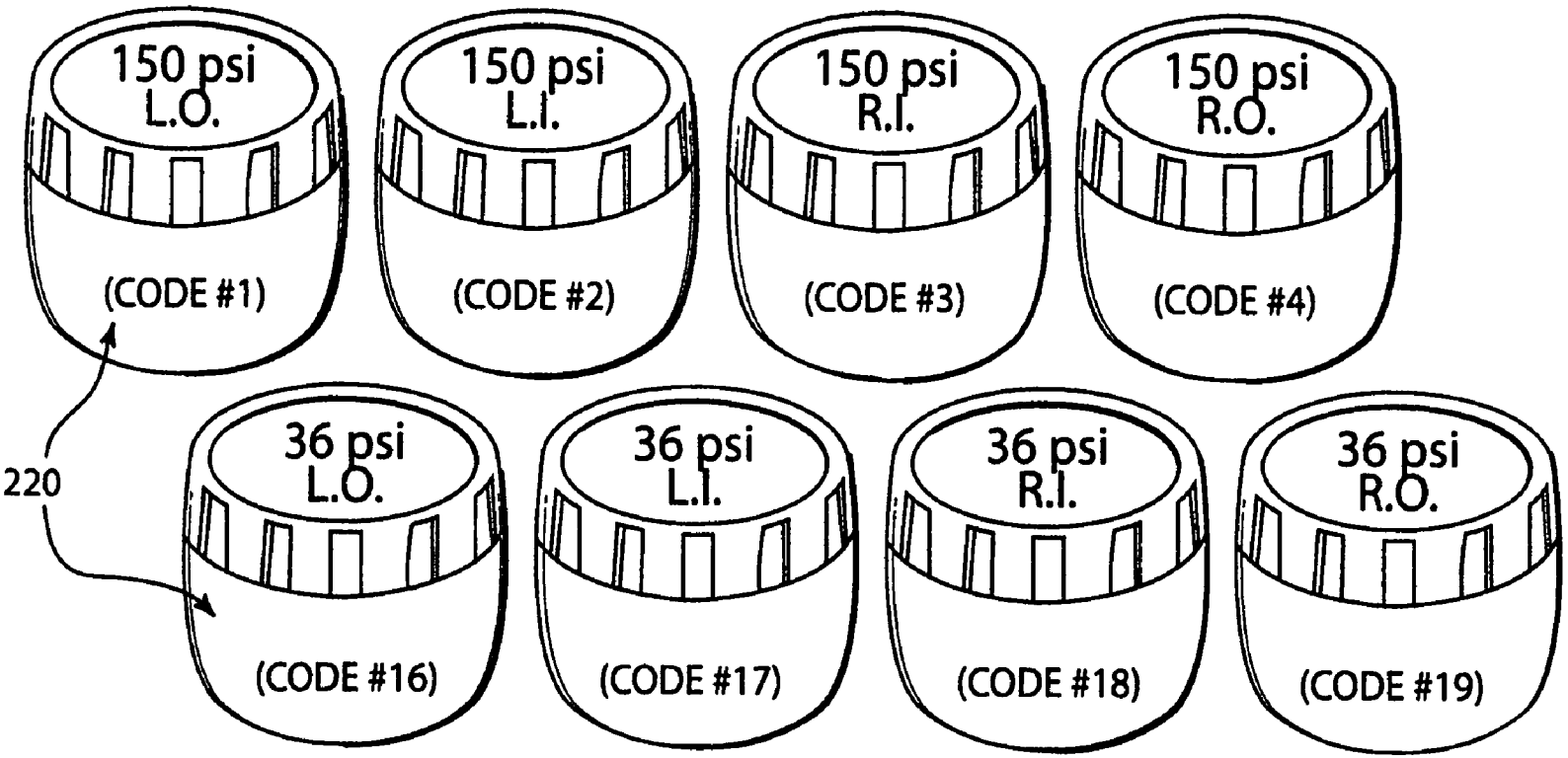
FIG. 9 is a schematic of a tire pressure monitoring system for use with the closed loop transfer system of the present invention.

Referring now to FIGS. 1 and 9, the closed loop fuel delivery and receiving system 10 of the present invention may also include an arrangement for monitoring tire pressures of the vehicles being fueled. In this embodiment, each movable vehicle includes a plurality of axles and tires. Each tire includes a plurality of stem cap tire-pressure sensor elements 220 of known design. Each sensor element 220 is mounted on one vehicle tire and is designed for monitoring the tire pressure thereof relative to a pre-established pressure code at any desired tire pressure. Each sensor element includes a transmitter member for communicating tire pressure relative to the code. The narrow band reader element 196 is adapted to receive and display coded tire pressures relative to the orientation of the movable vehicle as it pulls into the fueling lane 198.

In this system, there are only four codes which are pre-established for vehicle tires. These include a right outer tire, a right inner tire, a left outer tire and a left inner tire. The tire pressure is pre-established at a specific desired level, 150 psi for trucks for example, for all tires. A pressure of 36 psi may be selected for use with monitoring automobile tires. When there is a variance of the pressure (normally low pressure) of each tire from the pre-established tire pressure, this variance is displayed at the fuel delivery apparatus 10 relative to the orientation of the vehicle 40 as it enters the fueling lane 198. The base 182 may be utilized to display this information as well as house an air pressure hose for selective filling of tires. The associated codes displayed thereby enable adjustment of the appropriate tire pressure as needed at the site of fueling the vehicle 40. Since the coding system is based simply on vehicle orientation in the fueling lane 198, only four codes are needed for any fueling operation.

As can be seen from the above, the present invention focuses on the conversion of the receiving vehicle in a manner that results in the capture and containment of all of the liquid, vapor and pressure of delivered fluid. This is accomplished by providing a sealed loop for fluid transfer from a storage vessel to the receiving vehicle and back again to the starting point without an external release port. A dual path, vehicle-mounted conduit mates with a sealed dispensing delivery apparatus to form a closed loop or total containment fluid delivery system. The present invention includes an intrinsically safe and redundant fluid shut-off with a data transfer and receiving interconnect in one compact connection. The two system connection components connect, dispense and disconnect without the release of liquid or vapor contamination to the surrounding environment while simultaneously communicating information critical to the maintenance or management of the receiving vehicle. To accomplish this, the system of the invention includes a plurality of redundant safety arrangements to insure against environmental contamination.

The system of the invention is adaptable to a wide variety of vehicles from trucks to personal automobiles, but is particularly applicable to fleet vehicles. The vehicle fueling system of the invention is rapid, high volume, without risk of environmental contamination from fumes or liquids, and is robotically adaptable. The invention also provides a system for diagnosing and reporting the condition of vehicle subsystems while refueling and is able to address the needs for changing the conditions that are monitored. These systems may also include simultaneous monitoring and correction of tire pressure parameters during the refueling process utilizing a simplified coding system. The invention also provides a truck fueling system that enables the monitoring and addition of a plurality of other liquids required for truck operation substantially simultaneous with the fueling operation while utilizing the same delivery apparatus. Such information can enable fleet operators to track fuel and other operating parameters of vehicles in the fleet.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A closed loop system for transferring fluid with a vapor component from a fluid storage vessel to a fluid receiving container, which system is adapted to vent the fluid receiving container while preventing discharge of both vapor and fluid into the surrounding environment, said system comprising:

an enclosed fluid-receiving container having upper and lower portions;

a fluid flow receiving unit mounted proximate said fluid receiving container, said receiving unit having a pair of spaced fluid ports and a pair of non-spill coupling connectors extending from said fluid ports, one said port being a fluid inlet port and one said port being a vapor-fluid exit port, and a movable cover element for selectively covering and protecting said fluid ports and coupling connectors from contaminants when not in use;

a fluid inlet line interconnecting said receiving unit inlet port with the interior of said fluid receiving container for directing fluid into the lower portion of said receiving container, and a vacuum return line interconnecting said receiving unit exit port with the interior of said fluid receiving container upper portion, the distal end of said vacuum return line being disposed in said receiving container upper portion at a level to evacuate vapor and neutralize pressure from the upper portion of said receiving container and to establish a pre-selected maximum fluid level in said receiving container;

a fluid delivery apparatus including a dispensing head adapted for selective engagement with said receiving unit and having first and second end portions, said first end portion including a pair of spaced fluid coupling openings comprising a fluid delivery outlet and a vapor-fluid return inlet adapted for selective connection to the non-spill coupling connectors of, respectively, said receiving unit fluid inlet port and vapor-fluid exit port, and said second end portion having first and second fluid lines operatively coupling a fluid storage vessel with, respectively, said dispensing head fluid delivery outlet and vapor-fluid return inlet;

a fluid vacuum pump associated with the fluid storage vessel for delivering fluid under pressure to said dispensing head and retrieving vapor from said dispensing head vapor-fluid return inlet;

a fluid flow shut-off device disposed in said dispensing head and coupled to said vapor-fluid return inlet to prevent fluid flow therethrough; and a fluid flow termination element operatively connected to said fluid flow shut-off device to disengage said dispensing head from said receiving unit and terminate fluid flow from said storage vessel when activated by said shut-off device.

2. The closed loop system as claimed in claim 1, wherein said dispensing head first end portion and said receiving unit are mutually polarized to ensure proper connection of said dispensing head fluid delivery outlet and vapor-fluid return inlet with, respectively, said receiving unit fluid inlet port and said vapor-fluid exit port upon coupling of said dispensing head with said receiving unit, and wherein said first fluid line of said fluid delivery apparatus interconnects said storage vessel with said dispensing head fluid delivery outlet for delivering fluid under pressure from said pump to said dispersing head fluid delivery outlet, and said second fluid line of said fluid delivery apparatus interconnects said storage vessel with said dispensing head vapor-fluid return inlet for delivering vapor evacuated from said receiving container through said dispersing head vapor-fluid return inlet back to said storage vessel to provide total containment of all fluids and volatile vapors in said system.

3. The closed loop system as claimed in claim 1, wherein said fluid vacuum pump includes a vapor recovery vacuum member for recovering vapor from said fluid receiving container as fluid is introduced therein and direct such vapor to said storage vessel.

4. The closed loop system as claimed in claim 1, wherein said vacuum return line in said receiving container is adapted to direct fluid in excess of said pre-selected maximum fluid level in said receiving container back to said dispensing head fluid flow shut-off device to disengage said dispensing head from said receiving unit and terminate fluid flow from said storage vessel.

5. The closed loop system as claimed in claim 4, wherein said vacuum return line in said receiving container is adapted to direct excess fluid in said receiving container back to said storage vessel in the event of fluid flow shut-off device failure to prevent discharge of fluid and vapor into the environment.

6. The closed loop system as claimed in claim 4, wherein said fluid flow termination element comprises a solenoid disposed in said dispensing head arranged to disengage said dispensing head from said receiving unit upon activation thereof by said fluid flow shut-off device.

7. The closed loop system as claimed in claim 1, wherein said closed loop system includes a plurality of separate, redundant safety fluid shut-off components for termination of fluid flow without environmental contamination from fluids and vapors contained in said closed loop system.

8. The closed loop system as claimed in claim 7, wherein one said safety fluid shut-off component comprises a manually operable latch mechanism attached to said dispensing head for selectively disengaging said dispensing head first end portion from said receiving unit upon manual activation thereof.

9. The closed loop system as claimed in claim 7, wherein one said safety fluid shut-off component is in the form of said fluid flow shut-off device comprising a flow chamber having an internal float valve shut-off element adapted to permit the free flow of vapor through said chamber, and further adapted for movement caused by hydraulic pressure from the flow of fluid into said chamber to close said chamber to all vapor and fluid flow therein, and an electronic circuit coupling said fluid flow shut-off device with said fuel vacuum pump to signal said pump to shut down fluid flow to said fluid delivery apparatus upon activation of said fluid flow shut-off device.

10. The closed loop system as claimed in claim 7, wherein one said safety fuel shut-off component comprises said fluid flow termination element in the form of a solenoid disposed in said dispensing head and arranged to disengage said dispensing head first end portion from said receiving unit upon its activation by said fluid flow shut-off device in said dispensing head.

11. The closed loop system as claimed in claim 1, wherein said fluid inlet line comprises a terminal flow diverter valve at the distal end thereof in said fluid receiving container adapted to absorb the impact of incoming pressurized fluid flow while directing fluid flow radially outwardly therefrom along the bottom surface of said receiving container to prevent fuel foaming and deterioration impact of the container inner surface.

12. The closed loop system as claimed in claim 1, wherein said closed loop system includes a plurality of said fluid receiving containers interconnected for sequential fluid transfer.

13. The closed loop system as claimed in claim 12, wherein said plurality of fluid receiving containers comprises at least first and second fluid receiving containers, wherein said vacuum return line from said first fluid receiving container interconnects with the bottom portion of said second fluid receiving container and is adapted to provide fluid flow from said first fluid receiving container to said second fluid receiving container, and wherein a vacuum return line from said second fluid receiving container is interconnected to said receiving unit exit port.

14. The closed loop system as claimed in claim 1, wherein said fluid receiving container comprises a fuel tank mounted in a movable vehicle, and said receiving unit is mounted to the side of said vehicle accessible on the exterior surface of said vehicle.

15. The closed loop system as claimed in claim 14, wherein said non-spill coupling connectors comprise a pair of hermetic, quick-connect coupling elements adapted for rapid interconnection of said receiving unit fluid inlet port and vapor-fluid exit port with, respectively, said dispensing head fluid delivery outlet and vapor-fluid return inlet, said movable cover element adapted for selective movement between a closed position covering and protecting said fluid inlet port and said vapor-fluid exit port and associated hermetic coupling elements, and an open position permitting engagement of said dispensing head with said receiving unit.

16. The closed loop system as claimed in claim 14, wherein said closed loop system further comprises means for delivering a plurality of additional secondary fluids to a plurality of respective secondary reservoirs disposed in said vehicle including separate fluid lines interconnected by said dispensing head and said receiving unit, said secondary fluids being delivered substantially simultaneous with the transfer of fuel to said vehicle fuel tank.

17. The closed loop system as claimed in claim 14, wherein the vehicle includes a magnetic lock-out immobilization feature and said receiving unit further comprises a proximity switch element mounted thereto and connected to said vehicle lock-out immobilization feature, and wherein said dispensing head includes a magnetic activation switch mounted to said first end portion for contact with said receiving unit proximity switch when said dispensing head and said receiving unit are coupled, said magnetic activation switch energizing said proximity switch to immobilize the vehicle while said dispensing head is coupled to said receiving unit to prevent inadvertent movement of said vehicle during fluid transfer by said closed loop system.

18. The closed loop system as claimed in claim 14, wherein said dispensing head is manually engageable with said receiving unit.

19. The closed loop system as claimed in claim 14, wherein said wherein said dispensing head is robotically engageable with said receiving unit.

20. The closed loop system as claimed in claim 14, wherein said receiving unit further comprises a close range radio-frequency information transfer interface unit mounted thereto and adapted to receive information from associated features on said vehicle, and wherein said dispensing head includes a reader element mounted to said first end portion for contact with said interface unit when said dispensing head and said receiving unit are coupled, said reader element downloading information from said interface unit concerning selected functions and features of the vehicle while said dispensing head is coupled to said receiving unit.

21. The closed loop system as claimed in claim 14, wherein the power required to operate the components of said receiving unit is supplied by said dispensing head.

22. The closed loop system as claimed in claim 14, wherein said movable vehicle includes a plurality of axles and tires, wherein each said tire includes a stem cap tire-pressure sensor element thereon for monitoring the tire pressure thereof relative to a pre-established pressure code, wherein each said sensor element includes a transmitter member for communicating tire pressure relative to said code, and wherein said system further comprises a narrow band reader element adapted to receive and display coded tire pressures relative to the orientation of the movable vehicle as it pulls into a fueling lane in which said fuel delivery apparatus is mounted.

23. The closed loop system as claimed in claim 22, wherein four codes are pre-established for vehicle tires and include a right outer tire, a right inner tire, a left outer tire and a left inner tire, wherein tire pressure is pre-established at a specific desired level for all tires, and wherein variance of the pressure of each tire from said pre-established pressure is displayed at said fuel delivery apparatus relative to the orientation of the vehicle as it enters the fueling lane and the associated codes displayed thereby to enable adjustment of the appropriate tire pressure as needed.

24. A closed loop fuel delivery system for transferring fuel with a vapor component from a fuel storage vessel to a fuel tank located on-board a movable vehicle, which system is adapted to vent the fuel tank while preventing discharge of both vapor and fuel into the surrounding environment, said system comprising:

a fuel storage vessel including a fuel pump associated therewith for delivering fuel under pressure;

a fuel delivery apparatus including a dispensing head having first and second end portions, said first end portion including a fuel delivery port and a vapor-fuel return port spaced from each other, and said second end portion including a first fuel flow line interconnecting said storage vessel with said dispensing head fuel delivery port for delivering fuel under pressure from said pump to said dispersing head, and a second vapor-fuel flow line interconnecting said storage vessel with said dispensing head vapor-fuel return port for delivering vapor and overflow fuel evacuated from said vehicle fuel tank back to said storage vessel to provide total containment of all fuel and volatile vapors in said system;

a fuel receiving unit mounted in said vehicle and having a pair of spaced fluid ports, one said port being a fuel inlet port and one said port being a vapor-fuel exit port, and a movable cover element for selectively covering and protecting said receiving unit fuel ports from contaminants when not in use;

a pair of quick-connect, air and liquid-tight coupling members interconnecting, respectively, said fuel delivery port with said fuel inlet port and said vapor-fuel return port with said vapor exit port upon coupling of said dispensing head with said receiving unit, each said coupling member having a male portion connected to one said port and a female portion connected to the opposite interconnecting port;

an enclosed fuel tank disposed in said vehicle and having upper and lower portions, said tank further including a fuel inlet line interconnecting said fuel inlet port at said receiving unit with the lower portion interior of said fuel tank for directing fuel into the lower portion of said tank, and a vapor outlet line interconnecting said vapor exit port at said receiving unit with the interior of said fuel tank upper portion, the distal end of said vapor outlet line being disposed in said fuel tank upper portion at a level to evacuate vapor and neutralize pressure from the upper portion of said tank and directing said vapor to said storage vessel as fluid is introduced into said tank, said distal end establishing a pre-selected maximum fuel level in said tank;

a magnetic lock-out immobilization device mounted to said vehicle to selectively prevent movement thereof;

a proximity switch element mounted to said receiving unit and connected to said vehicle lock-out immobilization device;

a magnetic activation switch mounted to said dispensing head first end portion for contact with said receiving unit proximity switch when said dispensing head and said receiving unit are coupled, said magnetic activation switch energizing said proximity switch to activate said lock-out immobilization device and immobilize the vehicle while said dispensing head is coupled to said receiving unit to prevent inadvertent movement of said vehicle during fuel transfer by said closed loop system;

a fuel flow shut-off device disposed in said dispensing head and coupled to said vapor-fuel return port to prevent fluid flow therethrough; and a fuel flow termination element operatively connected to said fuel flow shut-off device to disengage said dispensing head from said receiving unit and terminate fuel flow from said storage vessel when activated by said shut-off device.

25. The fuel delivery and receiving system as claimed in claim 24, wherein said vapor outlet line in said fuel tank is adapted to direct fuel in excess of said pre-selected maximum fuel level in said fuel tank back to said dispensing head fuel flow shut-off device to activate said shut-off device, and wherein said vapor outlet line in said fuel tank is further adapted to direct excess fuel in said fuel tank back to said storage vessel in the event of fuel flow shut-off device failure to prevent discharge of fuel and vapor into the environment.

26. The fuel delivery and receiving system as claimed in claim 24, wherein said fuel flow shut-off device comprises a flow chamber having an internal float valve shut-off element adapted to permit the free flow of vapor through said chamber and further adapted for movement caused by hydraulic pressure from the flow of fuel into said chamber to close said chamber to all vapor and fuel flow therein, and an electronic circuit coupling said fluid flow shut-off device with said fuel vacuum pump to signal said pump to shut down fuel flow to said fuel delivery apparatus upon activation of said fuel flow shut-off device, wherein said fluid flow termination element comprises a solenoid disposed in said dispensing head, and wherein said fuel flow termination element further includes a safety component in the form of a manually operable latch mechanism attached to said dispensing head for selectively manually disengaging said dispensing head first end portion from said receiving unit in the event of failure of said solenoid.

27. The fuel delivery and receiving system as claimed in claim 24, wherein said system further comprises means for delivering a plurality of additional secondary fluids to a plurality of respective secondary reservoirs disposed in said vehicle including separate fluid lines interconnected by said dispensing head and said receiving unit, said secondary fluids being delivered substantially simultaneous with the transfer of fuel to said vehicle fuel tank, a close range radio-frequency information transfer interface unit mounted to said receiving unit and adapted to receive information from associated features on said vehicle, and a reader element mounted to said dispensing head first end portion for contact with said interface unit when said dispensing head and said receiving unit are coupled, said reader element adapted to download information from said interface unit concerning selected functions and features of the vehicle while said dispensing head is coupled to said receiving unit.

28. A closed loop system for transferring fluid with a vapor component from a fluid storage vessel to a fluid receiving container, which system is adapted to vent the fluid receiving container while preventing discharge of both vapor and fluid into the surrounding environment, said system comprising:

an enclosed fluid receiving container having upper and lower portions;

a fluid flow receiving unit mounted proximate said fluid receiving container, said receiving unit having a pair of spaced fluid ports and a pair of non-spill coupling connectors extending from said fluid ports, one said port being a fluid inlet port and one said port being a vapor-fluid exit port, and a movable cover element for selectively covering and protecting said fluid ports and coupling connectors from contaminants when not in use;

a fluid inlet line interconnecting said receiving unit inlet port with the interior of said fluid receiving container for directing fluid into the lower portion of said receiving container, and a vacuum return line interconnecting said receiving unit exit port with the interior of said fluid receiving container upper portion, the distal end of said vacuum return line being disposed in said receiving container upper portion at a level to evacuate vapor and neutralize pressure from the upper portion of said receiving container and to establish a pre-selected maximum fluid level in said receiving container;

a fluid delivery apparatus including a dispensing head adapted for selective engagement with said receiving unit and having first and second end portions, said first end portion including a pair of spaced fluid coupling openings comprising a fluid delivery outlet and a vapor-fluid return inlet adapted for selective connection to the non-spill coupling connectors of, respectively, said receiving unit fluid inlet port and vapor-fluid exit port, and said second end portion having first and second fluid lines operatively coupling a fluid storage vessel with, respectively, said dispensing head fluid delivery outlet and vapor-fluid return inlet;

a fluid vacuum pump associated with the fluid storage vessel for delivering fluid under pressure to said dispensing head and retrieving vapor from said dispensing head vapor-fluid return inlet;

a fluid flow shut-off device disposed in said dispensing head and coupled to said vapor-fluid return inlet to prevent fluid flow therethrough, said vacuum return line in said receiving container being adapted to direct fluid in excess of said pre-selected maximum fluid level in said receiving container back to said dispensing head fluid flow shut-off device to activate said shut-off device; and a fluid flow termination element operatively connected to said fluid flow shut-off device to disengage said dispensing head from said receiving unit and terminate fluid flow from said storage vessel when activated by said shut-off device, said vacuum return line in said receiving container being adapted to direct excess fluid in said receiving container back to said storage vessel in the event of fluid flow shut-off device failure to prevent discharge of fluid and vapor into the environment.

29. The fuel delivery and receiving system as claimed in claim 28, wherein said fluid flow termination element comprises a solenoid disposed in said dispensing head arranged to disengage said dispensing head from said receiving unit upon activation thereof by said fluid flow shut-off device.

30. A closed loop system for transferring fluid with a vapor component from a fluid storage vessel to a fluid receiving container, which system is adapted to vent the fluid receiving container while preventing discharge of both vapor and fluid into the surrounding environment, said system comprising:

an enclosed fluid receiving container having upper and lower portions;

a fluid flow receiving unit mounted proximate said fluid receiving container, said receiving unit having a pair of spaced fluid ports and a pair of non-spill coupling connectors extending from said fluid ports, one said port being a fluid inlet port and one said port being a vapor-fluid exit port, and a movable cover element for selectively covering and protecting said fluid ports and coupling connectors from contaminants when not in use;

a fluid inlet line interconnecting said receiving unit inlet port with the interior of said fluid receiving container for directing fluid into the lower portion of said receiving container, and a vacuum return line interconnecting said receiving unit exit port with the interior of said fluid receiving container upper portion, the distal end of said vacuum return line being disposed in said receiving container upper portion at a level to evacuate vapor and neutralize pressure from the upper portion of said receiving container and to establish a pre-selected maximum fluid level in said receiving container;

a fluid delivery apparatus including a dispensing head adapted for selective engagement with said receiving unit and having first and second end portions, said first end portion including a pair of spaced fluid coupling openings comprising a fluid delivery outlet and a vapor-fluid return inlet adapted for selective connection to the non-spill coupling connectors of, respectively, said receiving unit fluid inlet port and vapor-fluid exit port, and said second end portion having first and second fluid lines operatively coupling a fluid storage vessel with, respectively, said dispensing head fluid delivery outlet and vapor-fluid return inlet;

a fluid vacuum pump associated with the fluid storage vessel for delivering fluid under pressure to said dispensing head and retrieving vapor from said dispensing head vapor-fluid return inlet;

a fluid flow shut-off device disposed in said dispensing head and coupled to said vapor-fluid return inlet to prevent fluid flow therethrough, said shut-off device comprising a flow chamber having an internal float valve shut-off element adapted to permit the free flow of vapor through said chamber, and further adapted for movement caused by hydraulic pressure from the flow of fluid into said chamber to close said chamber to all vapor and fluid flow therein, and an electronic circuit coupling said fluid flow shut-off device with said fuel vacuum pump to signal said pump to shut down fluid flow to said fluid delivery apparatus upon activation of said fluid flow shut-off device; and a fluid flow termination element comprising a solenoid disposed in said dispensing head operatively connected to said fluid flow shut-off device and arranged to disengage said dispensing head first end portion from said receiving unit and terminate fluid flow from said storage vessel upon its activation by said fluid flow shut-off device, said fluid flow termination element further including a safety component in the form of a manually operable latch mechanism attached to said dispensing head for selectively manually disengaging said dispensing head first end portion from said receiving unit in the event of failure of said solenoid.

31. The closed loop system as claimed in claim 30, wherein said fluid receiving container is disposed in a movable vehicle, and said system further comprises a magnetic lock-out immobilization device mounted to said vehicle to selectively prevent movement thereof, a proximity switch element mounted to said receiving unit and connected to said vehicle lock-out immobilization device, and a magnetic activation switch mounted to said dispensing head first end portion for contact with said receiving unit proximity switch when said dispensing head and said receiving unit are coupled, said magnetic activation switch energizing said proximity switch to activate said lock-out immobilization device and immobilize the vehicle while said dispensing head is coupled to said receiving unit to prevent inadvertent movement of said vehicle during fluid transfer by said closed loop system.

32. The closed loop system as claimed in claim 31, wherein said system further comprises means for delivering a plurality of additional secondary fluids to a plurality of respective secondary reservoirs disposed in said vehicle including separate fluid lines interconnected by said dispensing head and said receiving unit, said secondary fluids being delivered substantially simultaneous with the transfer of fluids to said vehicle receiving container, a close range radio-frequency information transfer interface unit mounted to said receiving unit and adapted to receive information from associated features on said vehicle, and a reader element mounted to said dispensing head first end portion for contact with said interface unit when said dispensing head and said receiving unit are coupled, said reader element adapted to download information from said interface unit concerning selected functions and features of the vehicle while said dispensing head is coupled to said receiving unit.

33. A closed loop fuel delivery and receiving system for transferring fuel with a vapor component from a fuel storage vessel to a series of interconnected fuel tanks located on-board a movable vehicle, which system is adapted to vent the fuel tanks while preventing discharge of both vapor and fuel into the surrounding environment, said system comprising:

a plurality of enclosed fuel tanks each having an upper and a lower portion, said plurality of receiving containers comprising at least first and second fuel tanks;

a fuel receiving unit mounted to the side of said vehicle accessible on the exterior surface of said vehicle and having a pair of spaced fluid ports and a pair of non-spill coupling connectors extending from said fluid ports, one said port being a fuel inlet port and one said port being a vapor-fuel exit port, and a movable cover element for selectively covering and protecting said receiving unit fuel ports and coupling connectors from contaminants when not in use;

a fuel inlet line interconnecting said receiving unit inlet port with the interior of the first said fuel tank lower portion for directing fuel into the lower portion of said first fuel tank;

a first vacuum return line interconnecting the upper portion of said first fuel tank and the bottom portion of said second fuel tank and adapted to provide fuel flow from said first fuel tank to said second fuel tank, the interior end of said first vacuum return line in said first fuel tank upper portion being at a level to evacuate vapor and neutralize pressure from the upper portion of said first fuel tank and to establish a pre-selected maximum fluid level in said first fuel tank;

a second vacuum return line interconnecting the upper portion of said second fuel tank with said receiving unit exit port, the distal end of said second vacuum return line being disposed in said second fuel tank upper portion at a level to evacuate vapor and neutralize pressure from the upper portion of said second fuel tank and to establish a pre-selected maximum fluid level in said second fuel tank;

a fuel delivery apparatus including a dispensing head adapted for selective engagement with said receiving unit and having first and second end portions, said first end portion including a pair of spaced fluid coupling openings comprising a fuel delivery outlet and a vapor-fuel return inlet adapted for selective connection to the non-spill coupling connectors of, respectively, said receiving unit fuel inlet port and vapor-fuel exit port, and said second end portion having first and second fuel lines operatively coupling a fuel storage vessel with, respectively, said dispensing head fuel delivery outlet and vapor-fuel return inlet;

a fuel vacuum pump associated with the fuel storage vessel for delivering fuel under pressure to said dispensing head and retrieving vapor from said dispensing head vapor-fuel return inlet;

a fluid flow shut-off device disposed in said dispensing head and coupled to said vapor-fluid return inlet to prevent fluid flow therethrough; and a fuel flow termination element operatively connected to said fuel flow shut-off device to disengage said dispensing head from said receiving unit and terminate fuel flow from said storage vessel when activated by said shut-off device.

34. A closed loop fuel delivery and receiving system for transferring fuel with a vapor component from a fuel storage vessel to a fuel tank located on-board a movable vehicle, which system is adapted to vent the fuel tank while preventing discharge of both vapor and fuel into the surrounding environment, said system comprising:

an enclosed fuel tank having upper and lower portions and disposed in a movable vehicle;

a fuel flow receiving unit mounted to the side of said vehicle accessible on the exterior surface of said vehicle, said receiving unit having a pair of spaced fuel ports and a pair of non-spill coupling connectors extending from said fuel ports, one said port being a fuel inlet port and one said port being a vapor-fuel exit port, and a movable cover element for selectively covering and protecting said fuel ports and coupling connectors from contaminants when not in use;

a fuel inlet line interconnecting said receiving unit inlet port with the interior of said fuel tank for directing fuel into the lower portion of said fuel tank, and a vacuum return line interconnecting said receiving unit exit port with the interior of said fuel tank upper portion, the distal end of said vacuum return line being disposed in said fuel tank upper portion at a level to evacuate vapor and neutralize pressure from the upper portion of said receiving container and to establish a pre-selected maximum fuel level in said fuel tank;

a fuel delivery apparatus including a dispensing head adapted for selective engagement with said receiving unit and having first and second end portions, said first end portion including a pair of spaced fuel coupling openings comprising a fuel delivery outlet and a vapor-fuel return inlet adapted for selective connection to the non-spill coupling connectors of, respectively, said receiving unit fuel inlet port and vapor-fuel exit port, and said second end portion having first and second fuel lines operatively coupling a fuel storage vessel with, respectively, said dispensing head fuel delivery outlet and vapor-fuel return inlet;

a fuel vacuum pump associated with the fuel storage vessel for delivering fuel under pressure to said dispensing head and retrieving vapor from said dispensing head vapor-fuel return inlet;

a fuel flow shut-off device disposed in said dispensing head and coupled to said vapor-fuel return inlet to prevent fuel flow therethrough;

a fuel flow termination element operatively connected to said fuel flow shut-off device to disengage said dispensing head from said receiving unit and terminate fuel flow from said storage vessel when activated by said shut-off device;

means for delivering a plurality of additional secondary fluids to a plurality of respective secondary reservoirs disposed in said vehicle including separate fluid lines interconnected by said dispensing head and said receiving unit, said secondary fluids being delivered substantially simultaneous with the transfer of fuel to said vehicle fuel tank;

a close range radio-frequency information transfer interface unit mounted to said receiving unit and adapted to receive information from associated features on said vehicle; and a reader element mounted to said dispensing head first end portion for contact with said interface unit when said dispensing head and said receiving unit are coupled, said reader element downloading information from said interface unit concerning selected functions and features of the vehicle while said dispensing head is coupled to said receiving unit.

35. A closed loop fuel delivery and receiving system for transferring fuel with a vapor component from a fuel storage vessel to a fuel tank located on-board a movable vehicle, which system is adapted to vent the fuel tank while preventing discharge of both vapor and fuel into the surrounding environment, said system comprising:

an enclosed fuel tank having upper and lower portions and disposed in a movable vehicle, said movable vehicle including a plurality of axles and tires and adapted for moving into a fueling lane associated with said delivery system;

a fuel flow receiving unit mounted to the side of said vehicle accessible on the exterior surface of said vehicle, said receiving unit having a pair of spaced fuel ports and a pair of non-spill coupling connectors extending from said fuel ports, one said port being a fuel inlet port and one said port being a vapor-fuel exit port, and a movable cover element for selectively covering and protecting said fuel ports and coupling connectors from contaminants when not in use;

a fuel inlet line interconnecting said receiving unit inlet port with the interior of said fuel tank for directing fuel into the lower portion of said fuel tank, and a vacuum return line interconnecting said receiving unit exit port with the interior of said fuel tank upper portion, the distal end of said vacuum return line being disposed in said receiving container upper portion at a level to evacuate vapor and neutralize pressure from the upper portion of said fuel tank and to establish a pre-selected maximum fuel level in said fuel tank;

a fuel delivery apparatus including a dispensing head adapted for selective engagement with said receiving unit and having first and second end portions, said first end portion including a pair of spaced fuel coupling openings comprising a fuel delivery outlet and a vapor-fuel return inlet adapted for selective connection to the non-spill coupling connectors of, respectively, said receiving unit fuel inlet port and vapor-fuel exit port, and said second end portion having first and second fuel lines operatively coupling a fuel storage vessel with, respectively, said dispensing head fuel delivery outlet and vapor-fuel return inlet, the power required to operate the components of said receiving unit being supplied by said dispensing head;

a fuel vacuum pump associated with the fuel storage vessel for delivering fuel under pressure to said dispensing head and retrieving vapor from said dispensing head vapor-fuel return inlet;

a fuel flow shut-off device disposed in said dispensing head and coupled to said vapor-fuel return inlet to prevent fuel flow therethrough;

a fuel flow termination element operatively connected to said fuel flow shut-off device to disengage said dispensing head from said receiving unit and terminate fuel flow from said storage vessel when activated by said shut-off device;

a plurality of stem cap tire-pressure sensor elements each being mounted on one said vehicle tire for monitoring the tire pressure thereof relative to a pre-established pressure code, each said sensor element including a transmitter member for communicating tire pressure relative to said code; and a narrow band reader element adapted to receive and display coded tire pressures relative to the orientation of the movable vehicle as it pulls into the fueling lane in which said fuel delivery apparatus is mounted.

36. The fuel delivery and receiving system as claimed in claim 35, wherein four codes are pre-established for vehicle tires and include a right outer tire, a right inner tire, a left outer tire and a left inner tire, wherein tire pressure is pre-established at a specific desired level for all tires, and wherein variance of the pressure of each tire from said pre-established pressure is displayed at said fuel delivery apparatus relative to the orientation of the vehicle as it enters the fueling lane and the associated codes displayed thereby to enable adjustment of the appropriate tire pressure as needed.

37. A fuel delivery pump and receiver system adapted to deliver fuel to a receiving tank and provide airtight interconnection and fuel flow between a storage vessel and a fluid receiving tank to prevent environmental contamination by either fuel or fuel vapor escaping the system, said system comprising:

a fluid delivery apparatus including a dispensing head having a first engagement plate, a fluid exit port and a vapor inlet port spaced from each other and disposed on said first engagement plate, and first and second fluid line attachment ducts for interconnecting with fluid lines originating from a fluid storage vessel;

a fluid flow receiving apparatus including a receiving unit having a second engagement plate sized and shaped to releasably connect with said first engagement plate, a fluid entry port and a vapor exit port disposed on said second engagement plate and spaced for alignment with, respectively, said first engagement plate fluid exit port and vapor inlet port upon coupling of said dispensing head with said receiving unit, a fluid inlet line communicating with said fluid inlet port at said receiving unit for placement within a fluid receiving tank to directing fluid into a lower portion of the receiving tank, and a vapor outlet line communicating with said vapor exit port at said receiving unit with the interior of the fluid receiving tank for evacuating vapor from an upper portion of the receiving tank as fluid is introduced into said receiving container;

a pair of hermetic coupling connectors interconnecting respectively said fluid exit and inlet ports and said vapor inlet and exit ports upon coupling of said dispensing head with said receiving unit; and a polarization connection mechanism disposed in said displacement head and said receiving unit to ensure proper connection of said fluid exit port with said fluid inlet port and said vapor inlet port with said fluid exit port upon coupling of said dispensing head with said receiving unit.

38. The fuel delivery pump and receiver system as claimed in claim 37, wherein said polarization connection mechanism comprises an irregular shaped first engagement plate and a mating irregular shaped second engagement plate.

39. The fuel delivery pump and receiver system as claimed in claim 37, wherein said polarization connection mechanism comprises each said hermetic coupling connector having a male member and a mating female member, the female members of the pair of coupling connectors being disposed on opposite engagement plates and the male members of the pair of coupling connectors likewise being disposed on opposite engagement plates.

40. A closed loop fuel delivery and receiving system for transferring fuel with a vapor component from a fuel storage vessel to a fuel tank located on-board a movable vehicle, which system is adapted to vent the fuel tank while preventing discharge of both vapor and fuel into the surrounding environment, said system comprising:

a fuel storage vessel including a fuel pump associated therewith for delivering fuel under pressure;

a fuel delivery apparatus including a dispensing head having first and second end portions, said first end portion including a fuel delivery port and a vapor-fuel return port spaced from each other, and said second end portion including a first fuel flow line interconnecting said storage vessel with said dispensing head fuel delivery port for delivering fuel under pressure from said pump to said dispersing head, and a second vapor-fuel flow line interconnecting said storage vessel with said dispensing head vapor-fuel return port for delivering vapor and overflow fuel evacuated from said vehicle fuel tank back to said storage vessel to provide total containment of all fuel and volatile vapors in said system, said fuel vacuum pump associated with the fuel storage vessel being adapted to both for deliver fuel under pressure to said dispensing head and retrieve vapor from said dispensing head vapor-fuel return port;

a fuel receiving unit mounted in said vehicle and having a pair of spaced fluid ports, one said port being a fuel inlet port and one said port being a vapor-fuel exit port, and a movable cover element for selectively covering and protecting said receiving unit fuel ports from contaminants when not in use, the power required to operate the components of said receiving unit being supplied by said dispensing head;

a pair of quick-connect, air and liquid-tight coupling members interconnecting, respectively, said fuel delivery port with said fuel inlet port and said vapor-fuel return port with said vapor-fuel exit port upon coupling of said dispensing head with said receiving unit, each said coupling member having a male portion connected to one said port and a female portion connected to the opposite interconnecting port;

an enclosed fuel tank disposed in said vehicle and having upper and lower portions, said tank further including a fuel inlet line interconnecting said fuel inlet port at said receiving unit with the lower portion interior of said fuel tank for directing fuel into the lower portion of said tank, and a vapor outlet line interconnecting said vapor-fuel exit port at said receiving unit with the interior of said fuel tank upper portion, the distal end of said vapor outlet line being disposed in said fuel tank upper portion at a level to evacuate vapor and neutralize pressure from the upper portion of said tank and directing said vapor to said storage vessel as fluid is introduced into said tank, said distal end establishing a pre-selected maximum fuel level in said tank;

means for delivering a plurality of additional secondary fluids to a plurality of respective secondary reservoirs disposed in said vehicle including separate fluid lines interconnected by said dispensing head and said receiving unit, said secondary fluids being delivered substantially simultaneous with the transfer of fuel to said vehicle fuel tank;

a magnetic lock-out immobilization device mounted to said vehicle to selectively prevent movement thereof;

a proximity switch element mounted to said receiving unit and connected to said vehicle lock-out immobilization device;

a magnetic activation switch mounted to said dispensing head first end portion for contact with said receiving unit proximity switch when said dispensing head and said receiving unit are coupled, said magnetic activation switch energizing said proximity switch to activate said lock-out immobilization device and immobilize the vehicle while said dispensing head is coupled to said receiving unit to prevent inadvertent movement of said vehicle during fuel transfer by said closed loop system;

a fuel flow shut-off device disposed in said dispensing head and coupled to said vapor-fuel return inlet to prevent fluid flow therethrough, said vapor outlet line in said fuel tank being adapted to direct fuel in excess of said pre-selected maximum fuel level in said fuel tank back to said dispensing head fluid flow shut-off device to activate said shut-off device, said shut-off device comprising a flow chamber having an internal float valve shut-off element adapted to permit the free flow of vapor through said chamber, and further adapted for movement caused by hydraulic pressure from the flow of fuel into said chamber to close said chamber to all vapor and fuel flow therein, and an electronic circuit coupling said fuel flow shut-off device with said fuel vacuum pump to signal said pump to shut down fuel flow to said fuel delivery apparatus upon activation of said fuel flow shut-off device;

a fuel flow termination element comprising a solenoid disposed in said dispensing head operatively connected to said fuel flow shut-off device and arranged to disengage said dispensing head first end portion from said fuel tank and terminate fuel flow from said storage vessel upon its activation by said fuel flow shut-off device, said vapor outlet line in said fuel tank being adapted to direct excess fuel in said fuel tank back to said storage vessel in the event of fuel flow shut-off device failure to prevent discharge of fuel and vapor into the environment; and a fuel flow termination element safety component in the form of a manually operable latch mechanism attached to said dispensing head for selectively manually disengaging said dispensing head first end portion from said receiving unit in the event of failure of said solenoid;

a close range radio-frequency information transfer interface unit mounted to said receiving unit and adapted to receive information from associated features on said vehicle; and a reader element mounted to said dispensing head first end portion for contact with said interface unit when said dispensing head and said receiving unit are coupled, said reader element downloading information from said interface unit concerning selected functions and features of the vehicle while said dispensing head is coupled to said receiving unit.

41. The closed loop fuel delivery and receiving system as claimed in claim 40, wherein said closed loop system includes a plurality of said fuel tanks interconnected for sequential fluid transfer, said plurality of fuel tanks comprising at least first and second fuel tanks, and wherein said vapor outlet line from said first fuel tank interconnects with the bottom portion of said second fuel tank and is adapted to provide vapor and fuel flow from said first fuel tank to said second fuel tank, and wherein a vapor outlet line from said second fuel tank is interconnected to said receiving unit vapor-fuel exit port.

42. The closed loop fuel delivery and receiving system as claimed in claim 40, wherein said movable vehicle includes a plurality of axles and tires, wherein each said tire includes a plurality of stem cap tire-pressure sensor elements each mounted on one said vehicle tire for monitoring the tire pressure thereof relative to a pre-established pressure code, wherein each said sensor element includes a transmitter member for communicating tire pressure relative to said code, and wherein a narrow band reader element is adapted to receive and display coded tire pressures relative to the orientation of the movable vehicle as it pulls into the fueling lane in which said closed loop fuel delivery and receiving system is mounted.

43. The closed loop fuel delivery and receiving system as claimed in claim 42, wherein four codes are pre-established for vehicle tires and include a right outer tire, a right inner tire, a left outer tire and a left inner tire, wherein tire pressure is pre-established at a specific desired level for all tires, and wherein variance of the pressure of each tire from said pre-established pressure is displayed at said fuel delivery apparatus relative to the orientation of the vehicle as it enters the fueling lane and the associated codes displayed thereby to enable adjustment of the appropriate tire pressure as needed.

* * * * *